US006285841B1

(12) United States Patent
Miho

(10) Patent No.: US 6,285,841 B1
(45) Date of Patent: Sep. 4, 2001

(54) IMAGE FORMING APPARATUS USING AN ASYMMETRIC WAVE PATTERN OF DEVELOPING BIAS VOLTAGE

(75) Inventor: Hiroaki Miho, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/354,007

(22) Filed: Jul. 15, 1999

(30) Foreign Application Priority Data

| | | |
|---|---|---|
| Jul. 21, 1998 | (JP) | 10-204991 |
| Aug. 18, 1998 | (JP) | 10-231671 |
| Aug. 19, 1998 | (JP) | 10-232929 |
| Aug. 19, 1998 | (JP) | 10-232930 |

(51) Int. Cl.[7] ..... G03G 15/06; G03G 15/01; G03G 15/09

(52) U.S. Cl. ..... 399/55; 399/223; 399/270

(58) Field of Search ..... 399/235, 270, 399/285, 281, 289, 55, 272; 430/122, 126, 267, 275, 282, 277, 223

(56) References Cited

U.S. PATENT DOCUMENTS

| | | | | |
|---|---|---|---|---|
| 3,879,737 | * | 4/1975 | Lunde | 399/267 X |
| 4,491,083 | * | 1/1985 | Itaya et al. | 399/275 X |
| 4,653,427 | * | 3/1987 | Hosaka et al. | 399/277 X |
| 4,841,332 | * | 6/1989 | Haneda et al. | 399/275 X |
| 4,916,492 | * | 4/1990 | Hoshika et al. | 399/272 |
| 5,001,517 | * | 3/1991 | Hosaka et al. | 399/270 |
| 5,172,169 | * | 12/1992 | Takashima et al. | 399/281 |
| 5,424,812 | * | 6/1995 | Kemmochi et al. | 399/270 |
| 5,574,543 | * | 11/1996 | Sakai et al. | 399/223 X |
| 5,625,441 | * | 4/1997 | Sugiyama et al. | 399/272 |
| 5,688,622 | * | 11/1997 | Ito et al. | 430/122 X |
| 5,698,354 | * | 12/1997 | Ugai et al. | 430/126 X |
| 5,752,140 | * | 5/1998 | Danzuka et al. | 399/270 |
| 5,911,098 | * | 6/1999 | Gyotoku et al. | 399/270 X |

FOREIGN PATENT DOCUMENTS

| | | | |
|---|---|---|---|
| 58-176662 | * | 10/1983 | (JP) . |
| 60-53968 | | 3/1985 | (JP) . |
| 60-134262 | | 7/1985 | (JP) . |
| 5-35063 | | 2/1993 | (JP) . |
| 63-8817 | * | 11/1994 | (JP) . |
| 6-348117 | | 12/1994 | (JP) . |
| 7-92786 | | 4/1995 | (JP) . |
| 7-295373 | | 11/1995 | (JP) . |
| 7-311497 | | 11/1995 | (JP) . |
| 8-160725 | | 6/1996 | (JP) . |
| 10-20674 | * | 1/1998 | (JP) . |

* cited by examiner

*Primary Examiner*—Susan S. Y. Lee
(74) *Attorney, Agent, or Firm*—Frishauf, Holtz, Goodman, Langer & Chick, P.C.

(57) ABSTRACT

An image forming apparatus, including: a charger, arranged around an image carrier, for charging a surface of the image carrier; an exposure device, arranged around the image carrier, for exposing the surface of the image carrier, after it is charged by the charger, and for forming an electrostatic latent image on the surface of the image carrier; a developer device, having a developer carrier and arranged around the image carrier, for carrying developer with which the electrostatic latent image is developed so as to obtain a developed image; and a transfer device, arranged around the image carrier, for transferring the developed image onto a transfer material. In the image forming apparatus, the developer device has a bias voltage application device for applying developing bias voltage, in which AC voltage and DC voltage are superimposed, between the developer carrier and the image carrier; the AC voltage is intermittently applied; and a waveform in one cycle of each pulse during a term, that AC voltage is applied, does not have a center of symmetry.

11 Claims, 13 Drawing Sheets

FIG. 5 ( a )
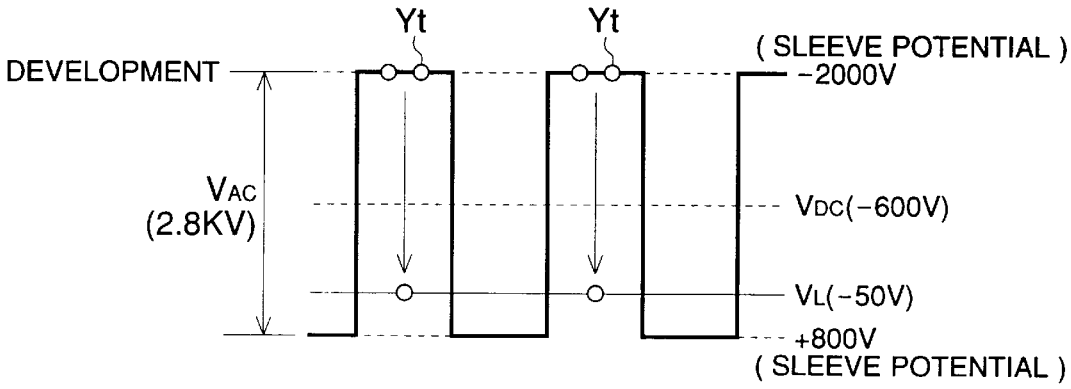
FIG. 5 ( b )
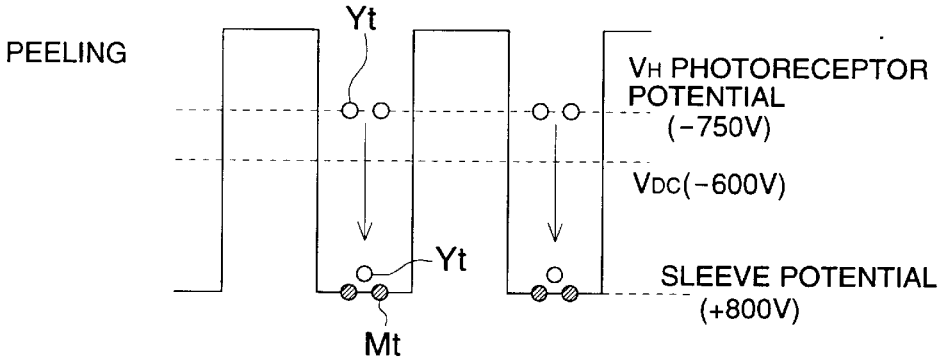

FIG. 8 ( a )
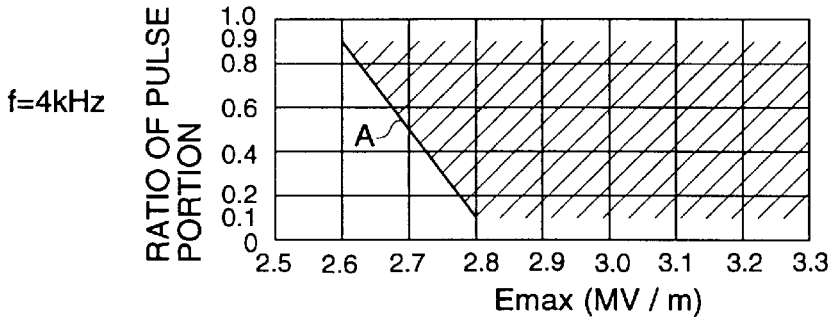
FIG. 8 ( b )
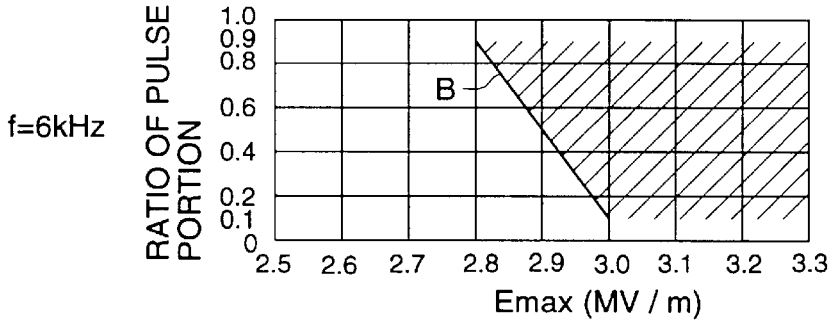
FIG. 8 ( c )
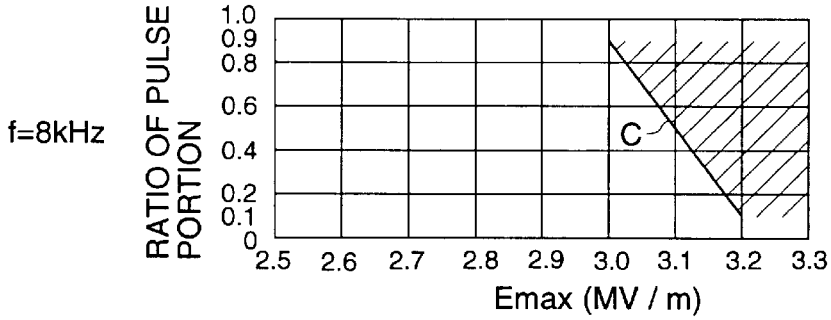
FIG. 8 ( d )
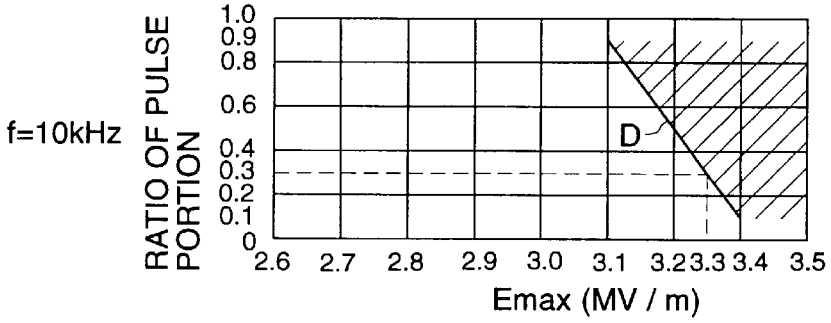

FIG. 9 ( a )
f=4kHz
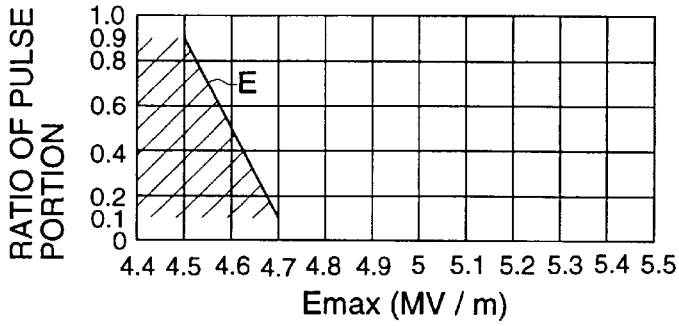
FIG. 9 ( b )
f=6kHz
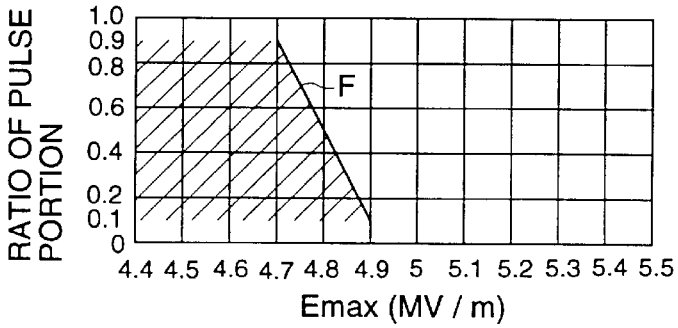
FIG. 9 ( c )
f=8kHz
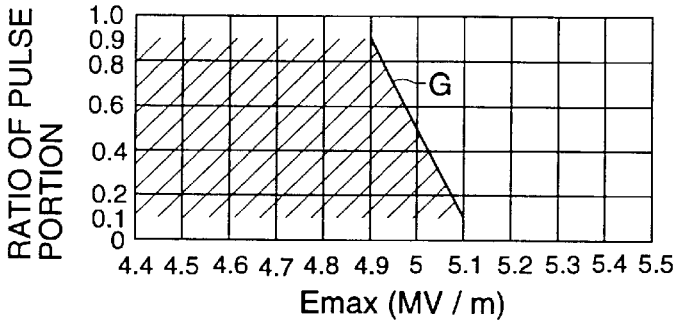
FIG. 9 ( d )
f=10kHz
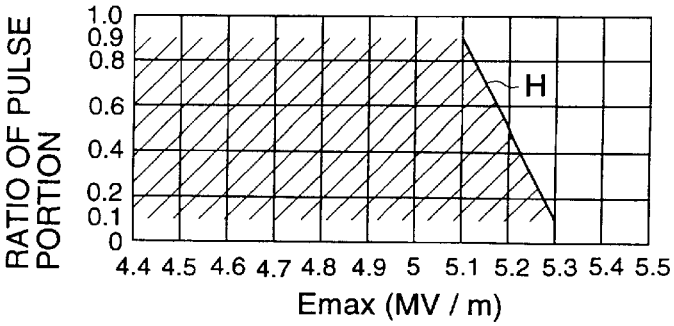

IMAGE FORMING APPARATUS USING AN ASYMMETRIC WAVE PATTERN OF DEVELOPING BIAS VOLTAGE

BACKGROUND OF THE INVENTION

The present invention relates to a developing apparatus to develop an electrostatic latent image on an image carrier and to form a visible image, and relates to an image forming apparatus such as a copier, printer, facsimile device, or similar devices, which is provided with the developing apparatus for image formation.

Conventionally, the following image forming apparatus is widely known: developer is carried on the surface of a developer carrier; the developer is conveyed to a developing area opposed to an image carrier carrying thereon an electrostatic latent image; and while AC voltage is continuously superimposed on DC voltage and these voltage are applied onto the developer carrier, the electrostatic latent image is developed and a visible image is formed.

Further, when the electrostatic latent image is developed, contact development such as magnetic brush development or the like, by which developer layer carried on the developer carrier is slid-contact with the image carrier; and non-contact development by which, in the developing area, toner particles are flied in the air layer from the developer carrier toward the image carrier, and thereby the electrostatic latent image is developed, are well known.

FIG. 10 is an enlarged typical view showing toner movement in the developing area in which the image carrier is opposed to the developer carrier.

For example, when non-contact development is conducted in the developing area, at an edge portion at which a gap exists in latent image potential on the image carrier, toner t in the vicinity of the edge portion on the opposing developer carrier (developing sleeve) is absorbed in a high density portion (a large potential area), and a toner adhering amount near the border portion increases more than expectation, and thereby, sometimes image density is increased. Further, sometimes an area onto which the toner t adheres more, spreads widely (hereinafter, such a phenomenon is referred to as "absorption").

Reversely, there is a case where the toner t adhered onto a low density portion (small potential area) adjoining a high density portion is absorbed in the high density portion as shown by a dashed line in FIG. 10, and as the result, the toner t hardly adheres onto the low density portion and the toner t on the low density portion is lost whitely (hereinafter, such the phenomenon is referred to as "white loss").

These absorption and white loss problems frequently occur in a non-contact development method.

A mechanism of generation of these absorption and white loss will be detailed more using a typical view in FIG. 10.

In the air layer in which toner is separated from the developer carrier (developing sleeve) and adheres onto the image carrier (photoreceptor), electric lines of force (shown by arrows in the drawing) are generated from an area (space) above the low density portion to an area (space) above the high density portion. These electric lines of force perpendicularly act on equipotential lines in the drawing.

Normally, it is considered that an adhering amount of toner onto an electrostatic latent image on the image carrier is determined unconditionally corresponding to latent image potential. However, actually, it is considered that toner t on the developer carrier opposed to the low density portion flies along the electric line of force, therefore an adhered amount of toner on the high density portion side at an edge portion is larger than that expected from the latent image potential, and an adhered amount of toner on the low density portion side at the edge portion is smaller than that expected from the latent image potential.

That is, when an AC continuous wave is applied onto the developer carrier, because the direction of electric field is cycled for each half cycle due to AC voltage, the movement direction of toner t is also changed for that time. Accordingly, toner flying speed in the vicinity of the changing point of the movement direction of toner t is decreased, therefore toner t easily moves along the electric line of force shown in FIG. 10, and the adhered amount of toner on the high density portion side at the edge portion is increased, resulting in generation of absorption. Due to this absorption, the adhered amount of toner on the low density portion side at the edge portion is decreased, resulting in white loss.

Further, even if toner t flies to the low density portion on the image carrier, the toner t finally lands on the high density portion when the toner t repeats bounding on the image carrier. This is also considered to be a cause for absorption and white loss.

In the non-contact development, in order to keep the developer layer on the developer carrier and the image carrier surface non-contact, it is necessary that the distance between the developer carrier surface and the image carrier surface is set to be longer than the case of the contact development. Due to this distance setting, curvature of the electric line of force becomes large, and absorption and white loss become conspicuous.

Further, although these absorption and white loss phenomena are not so conspicuous as in the case of the non-contact development, these phenomena are also generated in the contact development.

Concerning these absorption and white loss, recently it is discovered that, in the voltage waveform with which bias voltage in which DC voltage is superimposed onto AC voltage, is applied, when voltage having a blank portion to intermittently stop AC components, and having a waveform with which only DC components (blank pulse waveform) is impressed, is applied onto the developer carrier in the blank portion, the problems can be solved.

Well known references of the developing method using a blank pulse waveform in the conventional developing bias voltage are shown as follows: Japanese Tokkaihei No. 7-311497, No. 8-160725, No. 5-35063, Tokkaisho No. 60-134262, No. 60-53968, Tokkaihei No. 7-295373, No. 6-348117, No. 7-92786, and the like.

However, while the developing method shown in these well known references are effective for absorption and white loss, AC voltage which triggers the toner to be separated from the developer carrier surface, is not impressed on the developer carrier in the blank portion in which impression of AC voltage is stopped. Accordingly, a separated amount of toner is decreased, and there is a problem that the developability (toner adhesiveness) is decreased in general as compared to the continuous waveform portion which is not a blank portion.

SAMMARY OF THE INVENTION

An object of the present invention is to prevent the absorption and white loss, and to provide an image forming apparatus to prevent the developability (toner adhesiveness) from lowering.

Further, recently, small particle size toners are adopted to increase the image quality. However, the small particle size toner is easily affected by the electric line of force.

Accordingly, the object of the present invention is to provide an image forming apparatus to stably form a high quality image having high resolution and high gradation, by preventing absorption and white loss which are frequently generated when the toner particle size is small.

In order to attain the above object, an image forming apparatus of the present invention comprises, around an image carrier at least: a charging apparatus for charging the image carrier surface; an exposure apparatus for exposing the charged image carrier surface and for forming an electrostatic latent image; a developing apparatus having a developer carrier for carrying developer for developing the electrostatic latent image; and a transfer apparatus for transferring the developed image by the developing apparatus onto transfer material, the image forming apparatus being characterized in that the developing apparatus has a bias voltage application means for applying developing bias voltage, in which AC voltage and DC voltage are superimposed, between the developer carrier and image carrier; and the AC voltage has an asymmetrical waveform with respect to any point in a cycle of the AC voltage(a waveform in one cycle of each pulse during a term, that AC voltage is applied, does not have a center of symmetry), and is intermittently applied.

Further, in order to attain the above object, the developing apparatus of the present invention is characterized in that it has the developer carrier to carry developer in non-contact with the image carrier, and develops the electrostatic latent image formed on the image carrier by using developer; and voltage in which the AC component, which is asymmetrical with respect to any point and intermittently stopped, is superimposed onto the DC component, is applied onto the developer carrier carrying the developer, and a carrying and supplying amount of developer on the developer carrier is set to not less than 0.35 mg/cm$^2$.

Still further, in order to attain the above object, the image forming apparatus of the present invention is characterized in that, in an image forming apparatus in which an image is formed by superimposing a plurality of colors of images onto the image carrier, a plurality of the developing apparatus are provided for each of the plurality colors of images, and when an electrostatic latent image is formed on the image carrier for each color of the plurality of colors of images, and the electrostatic latent image is developed by the developing apparatus, a plurality of colors of superimposed images of are formed.

Yet further, in order to attain the above object, the image forming apparatus of the present invention is the apparatus which has an image carrier and a developing apparatus having a developing carrier which carries developer in non-contact with the image carrier, and develops an electrostatic latent image formed on the image carrier by the developer, the image forming apparatus being characterized in that voltage whose AC component, which is asymmetrical with respect to any point and is intermittently stopped, is superimposed onto the DC component, is applied onto the developer carrier carrying the developer, and the following relationship is satisfied.

$$(Vs/Vp)=2$$

where,

Vs peripheral speed of the developer carrier, and Vp: peripheral speed of the image carrier.

Furthermore, in order to attain the above object, the image forming apparatus of the present invention is characterized in that, in the image forming apparatus in which an image is formed by superimposing a plurality of colors of images on the image carrier, a plurality of developing apparatus are provided for each color of the plurality of colors of images, and when an electrostatic latent image is formed on the image carrier for each color of the plurality of colors of images and the electrostatic latent image is developed by the developing apparatus, a plurality of colors of superimposed images are formed.

Further, in order to attain the above object, a developing apparatus of the present invention has at least a developer carrier to carry developer, and a magnetic field generating means which is arranged inside the developer carrier and a plurality of magnetic poles are arranged in the rotating direction of the developer carrier, and develops an electrostatic latent image formed on an image carrier by the developer which is in no-contact with the image carrier, the developing apparatus being characterized in that the closest proximate portion on the developer carrier to the image carrier is set between different magnetic poles of the plurality of magnetic poles, and the voltage in which the AC component, which is asymmetrical and intermittently stopped, is superimposed onto the DC component, is applied onto the developer carrier.

Still further, in order to attain the above object, the image forming apparatus of the present invention is characterized in that, in the image forming apparatus to form an image by superimposing a plurality of colors of images onto the image carrier, the developing apparatus is provided for each color of the plurality of colors of images; and when an electrostatic latent image is formed on the image carrier for each color of the plurality of colors of images, and the electrostatic latent image is developed by the developing apparatus, the plurality of colors of superimposed images are formed.

BRIEF DESCRIPTION OF THE DRAWINGS

FIGS. 5(*a*) and 5(b) are views showing waveforms of developing bias voltage and an image defect.

FIGS. 8(*a*) through 8(d) are characteristic views showing relationships between the maximum electric field and ratios of pulse portion.

FIGS. 9(*a*) through 9(d) are characteristic views showing relationships between the maximum electric field and ratios of pulse portion.

DETAILED DESCRIPTION OF THE INVENTION

Prior to explanation of an embodiment of the present invention, a structure of a color printer, which is an example of an image forming apparatus of the present invention, and its operation will be described based on a structural sectional view of FIG. 1.

This color printer is a color image forming apparatus of such a type that, after toner images of a plurality of colors which are successively formed on an image carrier, are superimposed, superimposed color toner images are transferred once onto a recording sheet in a transfer section and thus a color image is formed, and then, the recording sheet is separated from the image carrier surface by a separation means.

Figure 1:
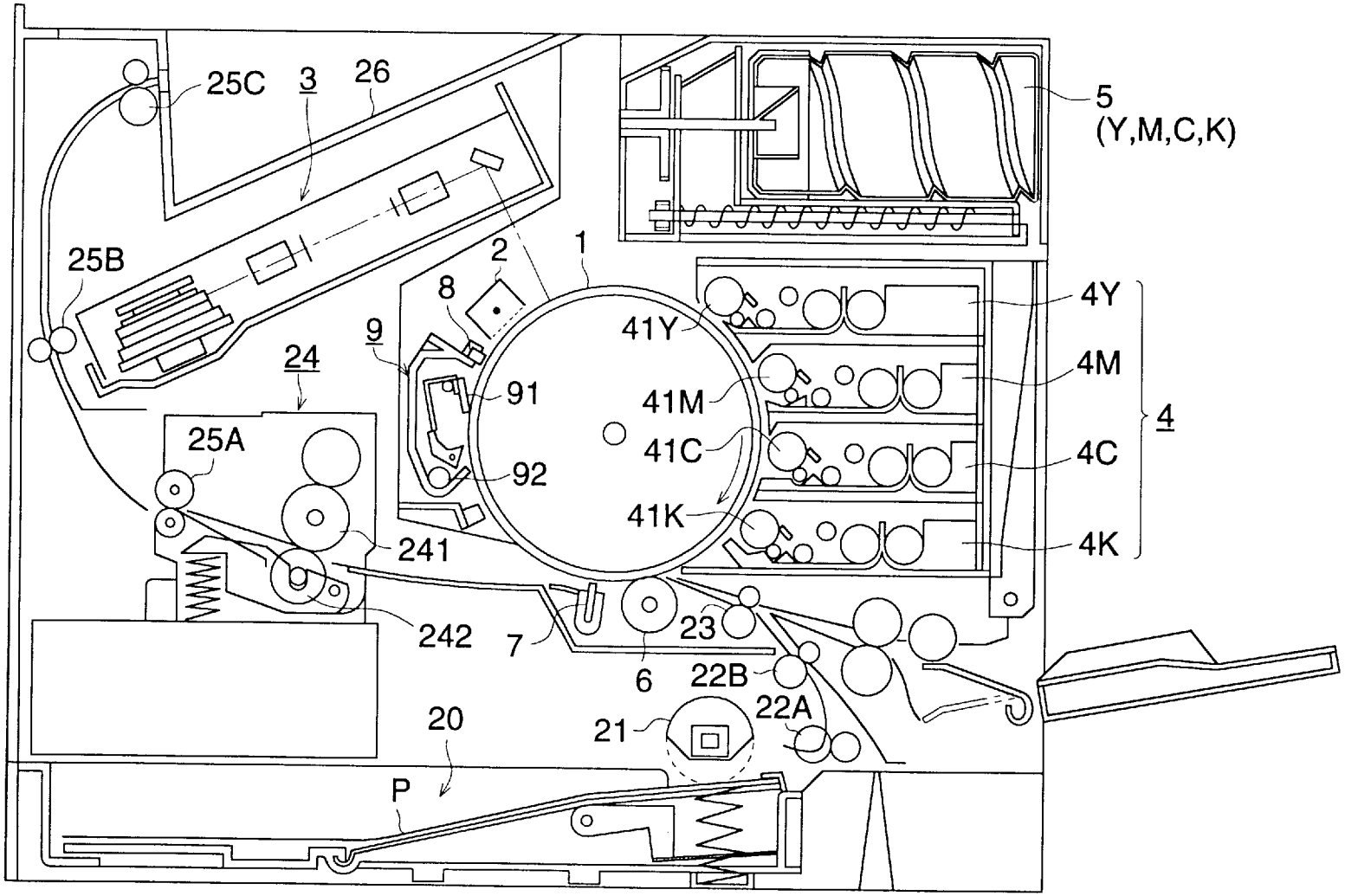
FIG. 1 is a structural sectional view of a color printer in which a plurality of sets of developing apparatus of the present invention are mounted.

In FIG. 1, numeral 1 is a photoreceptor drum (photoreceptor), which is an image carrier and an OPC photoreceptor (organic photoreceptor) is coated on a drum base body, and is electrically grounded and rotated clockwise. Numeral 2 is a scorotron charger (hereinafter, called charger), which uniformly charges the peripheral surface of the photoreceptor 1 with high photoreceptor charging potential $V_H$ by corona discharging using a grid, holding grid potential of $V_G$, and a corona discharging wire. Before charging by this charger 2, electric charges on the peripheral surface of the photoreceptor 1 are eliminated by exposure by a pre-charging eliminator (PCL) 8 using light emitting diodes or the like so that hysteresis of the photoreceptor 1 is eliminated. The hysteresis on the photoreceptor 1 is a static charge at the preceding image formation, and electrostatic latent image patterns formed by image exposure and remained on the photoreceptor 1.

After uniform charging on the photoreceptor 1, image exposure according to an image signal is conducted by an image exposure means 3, and an electrostatic latent image is formed on the surface of the photoreceptor 1. The image exposure means 3 conducts primary scanning by using laser diodes, not shown, as an light emitting source through a rotating polygonal mirror, an fθ lens, a cylindrical lens and reflection mirrors, and an electrostatic latent image is formed by rotation (subsidiary scanning) of the photoreceptor 1. In this embodiment, exposure is conducted on a portion onto which toner is expected to adhere, and a reversal latent image, in which an absolute value of latent image potential $V_L$ of an image portion (exposure portion) on the photoreceptor 1 is lower than an absolute value of photoreceptor charging potential $V_H$ on the photoreceptor 1, is formed ($|V_H|>|V_L|$).

A developing apparatus 4 composed of a plurality of developing units of 4Y, 4M, 4C, and 4K, in which two-component developer made of toners such as yellow (Y), magenta (M), cyan (C), and black (B), and carrier are respectively accommodated, is provided around the photoreceptor 1.

Initially, development of the first color of yellow is conducted by a developer carrier (developing sleeve) 41 in which a magnetic field generating means 42, composed of a plurality of magnetic bodies, is accommodated and which is rotated holding the developer. The developer is made of carrier in which magnetite is used as a core, around which insulating resins are coated, and toner in which polyester is used as a main material, and pigments corresponding to colors, charge control agents, silica, titan oxide, etc., are added to it. The developer is regulated to 100–600 μm thick developer layer on the developing sleeve 41 by a developer layer regulating member 43, which will be described later, and conveyed to the developing area.

A gap between the developing sleeve 41 and the photoreceptor 1 in the developing area is set to 0.5–1.0 mm, which is larger than the developer layer thickness, and AC voltage $V_{AC}$ and DC voltage $V_{DC}$ are superimposed, and applied onto the gap. Because the DC voltage $V_{DC}$ and the photoreceptor charging potential $V_H$ have the same polarity as that of toner charge, the toner triggered to be separated from the carrier by the AC voltage $V_{AC}$, does not adhere to a photoreceptor charging potential $V_H$ portion which has higher absolute potential than the DC voltage $V_{DC}$, but adheres to a latent image potential $V_L$ portion of the image portion (exposure portion) which has lower absolute potential than the DC voltage $V_{DC}$, and visualization (reversal development) is carried out. Here, the AC voltage $V_{AC}$ is a peak-to-peak effective value or the difference between the minimum voltage and the maxmum voltage shown as AC wave form in FIG. 5.

After the first color visualization has been completed, the sequence enters into the second color, magenta, image forming process and uniform charging by the scorotron charger 2 is conducted again, and a latent image according to the second color image data is formed by an image exposure means 3. In this case, the charge elimination by the PCL 8 conducted in the first color image forming process is not conducted because toner adhered to the first color image portion is scattered due to sudden lowering of surrounding potential.

In the photoreceptor surface charged again to charging potential $V_H$, expanding over the entire surface of the photoreceptor 1 peripheral surface, the same latent image as that of the first color is formed on a portion on which the first color image does not exist, and developed, however, in a location on which development is conducted again with respect to a portion on which the first color image exists, due to light shielding by adhered toner of the first color and the influence of electric charges of the toner itself, a latent image having a little higher potential $V_M$ than the latent image potential $V_L$ of the exposure portion of the first color is formed, and development corresponding to the potential difference between the DC bias voltage $V_{DC}$ and the potential $V_M$ is conducted.

Concerning also the third color of cyan and the fourth color of black, the same image formation process as that of the second color of magenta is conducted, and 4-color toner image is formed on the photoreceptor 1 peripheral surface.

Each new color toner is replenished to each of developing units 4Y, 4M, 4C, and 4K from a toner cartridge 5(Y, M, C, K).

A sheet of recording medium (recording sheet, or the like) P conveyed from a sheet feed cassette 20 through a semicircular roller 21 is stopped once near a register sensor position through an intermediate feed roller pair 22A and 22B, and is fed to a transfer area by the rotation of a register roller pair 23 of a sheet feed section, when transfer timing is adjusted.

In the transfer area, a transfer roller 6 to apply voltage for transferring the toner image is pressure-contacted with the peripheral surface of the photoreceptor 1 in timed relationship with transfer timing, and nips the fed recording medium P, and then 4-color toner images are collectively transferred onto the recording medium p.

Next, electric charges of the recording medium P is eliminated by a saw-toothed electrode 7; the recording medium P is separated from the peripheral surface of the photoreceptor 1 and conveyed to a fixing apparatus 24; after the transferred toner is fused by heating and pressing of a heat roller (upper roller) 241 and pressure roller (lower roller) 242, the recording medium P is delivered onto a delivery tray 26 provided outside the apparatus through a delivery roller set of 25A, 25B, and 25C. Incidentally, the transfer roller 6 is withdrawn from the peripheral surface of the photoreceptor 1 after passage of the recording medium P, and stands by the next toner image formation.

On the other hand, residual toner on the photoreceptor 1 from which the recording medium P is separated, is removed and cleaned by pressure-contact of a blade 91 of a cleaning apparatus 9, and the photoreceptor 1 is electrically charge-eliminated by the PCL 8 again and charged by a scorotron charger 2, and enters into the next image formation process. In this connection, after cleaning the photoreceptor 1, the blade 91 is immediately moved and withdrawn from the peripheral surface of the photoreceptor 1. Waste toner scraped off by the blade into the cleaning apparatus 9 is delivered by a screw 92, and then stored into a waste toner collection container, not shown.

Figure 2:
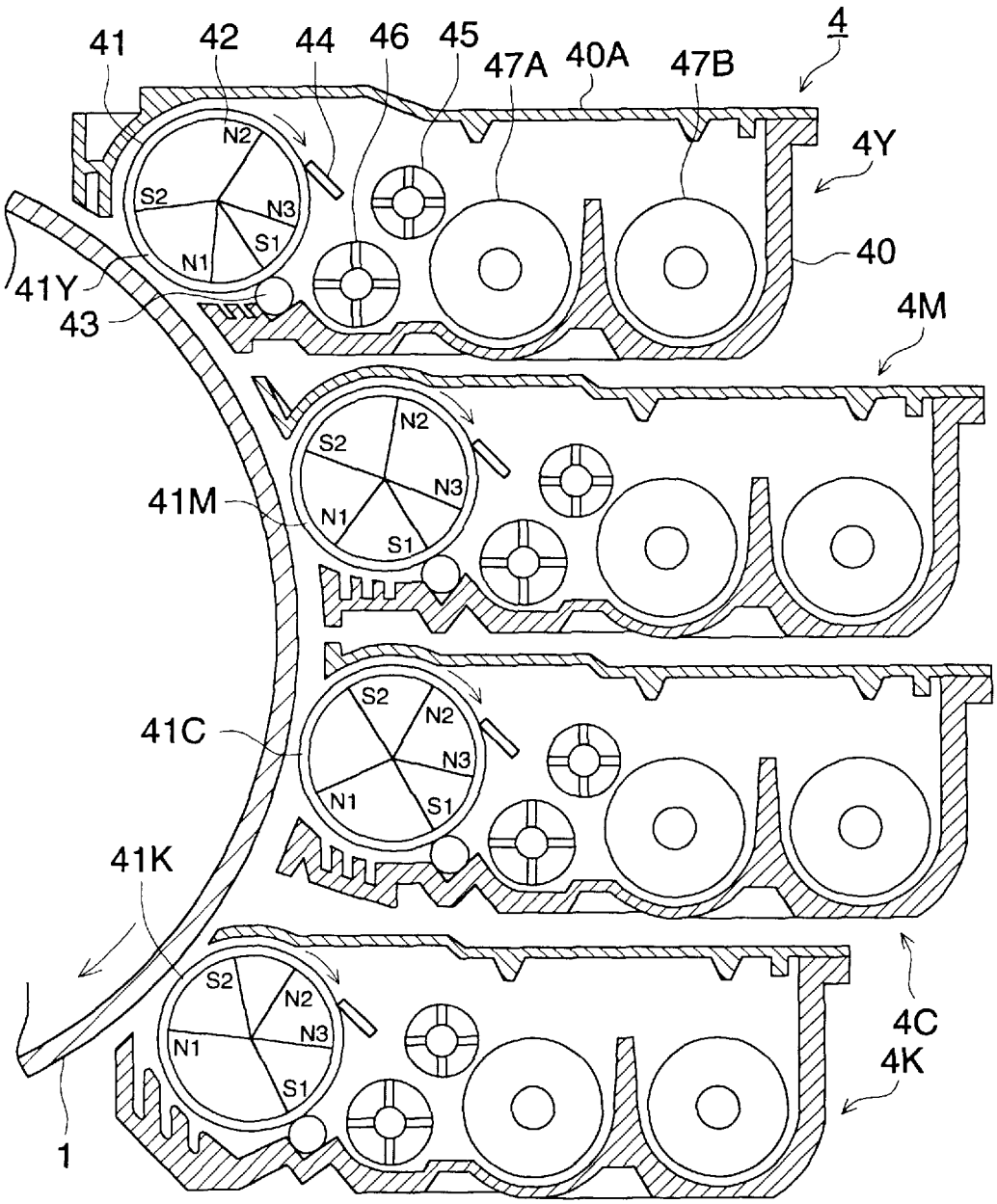
FIG. 2 is a sectional view of the developing apparatus composed of a plurality of sets of developing units of the present invention.

FIG. 2 is a sectional view of the developing apparatus 4 composed of a plurality of sets of developing units 4Y, 4M, 4C and 4K. In these developing units 4Y, 4M, 4C and 4K, developing sleeves 41Y, 41M, 41C and 41K are arranged in parallel to each other vertically facing to the photoreceptor surface of the photoreceptor 1.

Since these plural sets of developing units 4Y, 4M, 4C and 4K have almost the same structure to each other, the developing unit 4Y will be typically described hereinafter.

Figure 3:
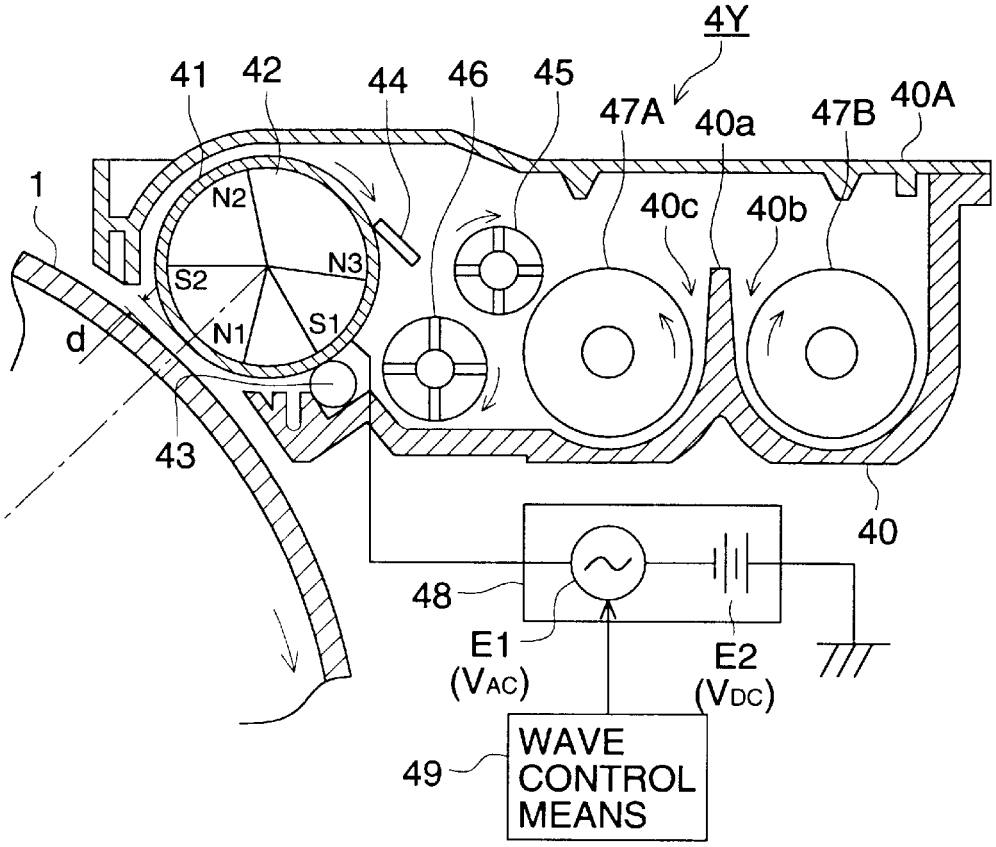
FIG. 3 is a sectional view of the developing apparatus of the present invention.

FIG. 3 is a sectional view of the developing unit 4Y.

In FIG. 3, numeral 40 is a developer container section to accommodate 2-component developer made of toner and carrier, numeral 41 is a developer carrier (developing sleeve) to hold and convey the developer, numeral 42 is a magnetic field generating means (hereinafter, referred to as magnetic roller) which is structured by arranging a plurality of fixed magnet bodies inside the developing sleeve 41, and numeral 43 is a developer layer regulating member (a member to regulate earing of developer) composed of a non-magnetic rod to regulate the developer layer thickness on the developing sleeve 41 to a predetermined value. Numeral 44 is a scraper to remove the developer adhered onto the developing sleeve 41 after development, numeral 45 is a paddle wheel-shape developer conveyance roller to convey the developer removed from the peripheral surface of the developing sleeve 41 by the scraper 44 to a developer stirring section, numeral 46 is a paddle wheel-shape developer supply roller to replenish the developer from the developer stirring section to the developing sleeve 41, and numerals 47A and 47B are developer stirring screws to stir the developer in the developer stirring section. Arrows in the drawing show the rotating direction of each roller. In this connection, as a developer removal means, instead of a scraper 44 pressure-contacted with the developing sleeve 41, a magnet may be arranged in proximity to the outer periphery of the developing sleeve 41, without coming into contact with the surface.

In the developing sleeve 41, the magnet roller 42 is fixed such that a plurality of N poles of N1, N2, and N3, and S poles of S1 and S2 are alternately arranged (5 poles arrangement). In these plurality of magnetic poles, 2 magnetic poles of N2 and N3 which are arranged adjacent to each other have the same polarity, and the repulsive magnetic field is formed by these adjoining magnetic poles N2 and N3 having the same polarity, and the developer on the developing sleeve 41 is removed. The magnetic pole SI faces the developer layer regulating member 43. A leading edge portion of the scraper 44 is pressure-contacted with the peripheral surface of the developing sleeve 41 in the vicinity of almost the intermediate position Nu between magnetic poles N2 and N3 having the same polarity.

The outer diameter of the developing sleeve 41 is preferably not less than ϕ8 mm, and not more than ϕ60 mm. When the outer diameter is not less than ϕ8 mm, it is easy to form the magnet roller 42 having at least 5 magnetic poles which are necessary for image formation.

When the outer diameter of the developing sleeve is not more than ϕ60 mm, it is easy to downsize the developing apparatus. Particularly, in a color printer having plural sets of developing apparatus (developing units 4Y, 4M, 4C, 4K) (refer to FIG. 1), when the developing apparatus is downsized, because the outer diameter of the photoreceptor 1 can be reduced, the recording medium P can be separated from the peripheral surface of the photoreceptor 1 by using curvature, after the transfer onto the recording medium P and charge-elimination. Further, when the developing apparatus 4 and the photoreceptor 1 are downsized, the image forming apparatus can be structured to be compact.

Incidentally, as the image forming apparatus according to the present invention, the Konica color printer KL-2010 (made by Konica) modified machine is used, and the outer diameter of the developing sleeve 41 is ϕ18 mm, and the outer diameter of the photoreceptor 1 is ϕ100 mm.

The developer layer regulating member 43 is formed of a rod of the magnetic member such as magnetic stainless steel (SUS).

The developer stirring screw 47A and the developer stirring screw 47B are parallely arranged respectively in the first stirring chamber 40*b* and the second stirring chamber 40*c* formed both side a partition wall 40*a* which is vertical from a bottom portion of a developing unit housing (developer container) 40, and rotated reversely to each other. The upper portion of the first stirring chamber 40*b* and the second stirring chamber 40*c* is closed by a lid 40A.

Toner replenished from the toner cartridge 5 is thrown and replenished into the first stirring chamber 40*b* of the developing unit housing 40 from a toner replenishing port (not shown) provided in the lid 40A, then, mixed with developer and stirred by developer stirring screws 47A and 47B in the first stirring chamber 40*b* and the second stirring chamber 40*c*, and supplied to the developing sleeve 41 by the developer supply roller 46. The thickness of layer of developer supplied onto the rotatable developing sleeve 41 accommodating the magnet roller 42 therein, is regulated by the developer layer regulating member, and the developer is conveyed to the developing area facing the photoreceptor 1, and non-contact development is conducted.

In FIG. 3, numeral 48 is a bias voltage applying means composed of an AC power source E1 and a DC power source E2, and numeral 49 is a waveform control means. The waveform control means 49 controls a stop portion (blank portion) time $T_B$ of an AC voltage waveform, pulse portion time $T_P$, a time ratio of the pulse portion and the stop portion ($T_P/(T_{P+}T_B)$) pulse magnitude, pulse frequency (f), etc., which will be described later.

Figure 4:
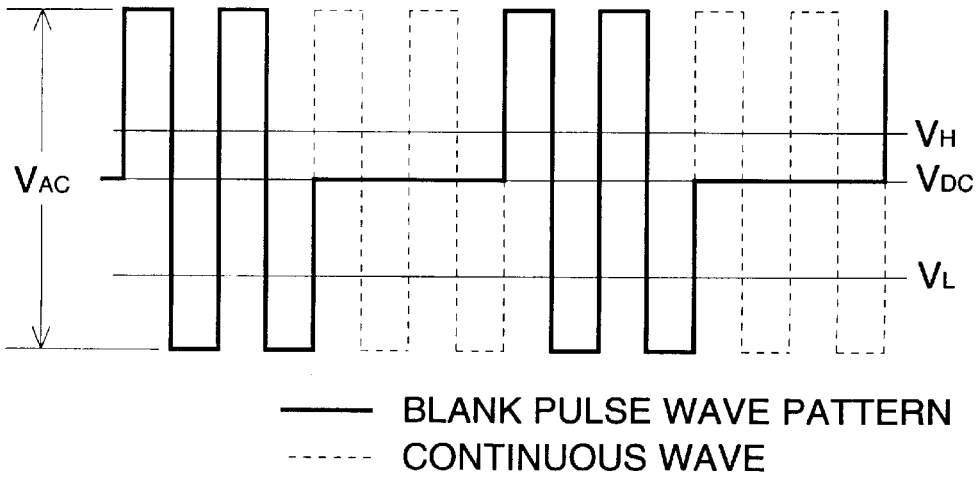
FIG. 4 is a view showing a waveform of blank pulses.

FIG. 4 is a view showing a waveform of blank pulses.

The wave form of the blank pulse is defined as follows: in the voltage waveform by which bias voltage formed by superimposing DC voltage on AC voltage, is applied, the waveform has a blank portion for intermittently stopping the AC component, and in the blank portion, only the DC component is applied.

Figure 10:
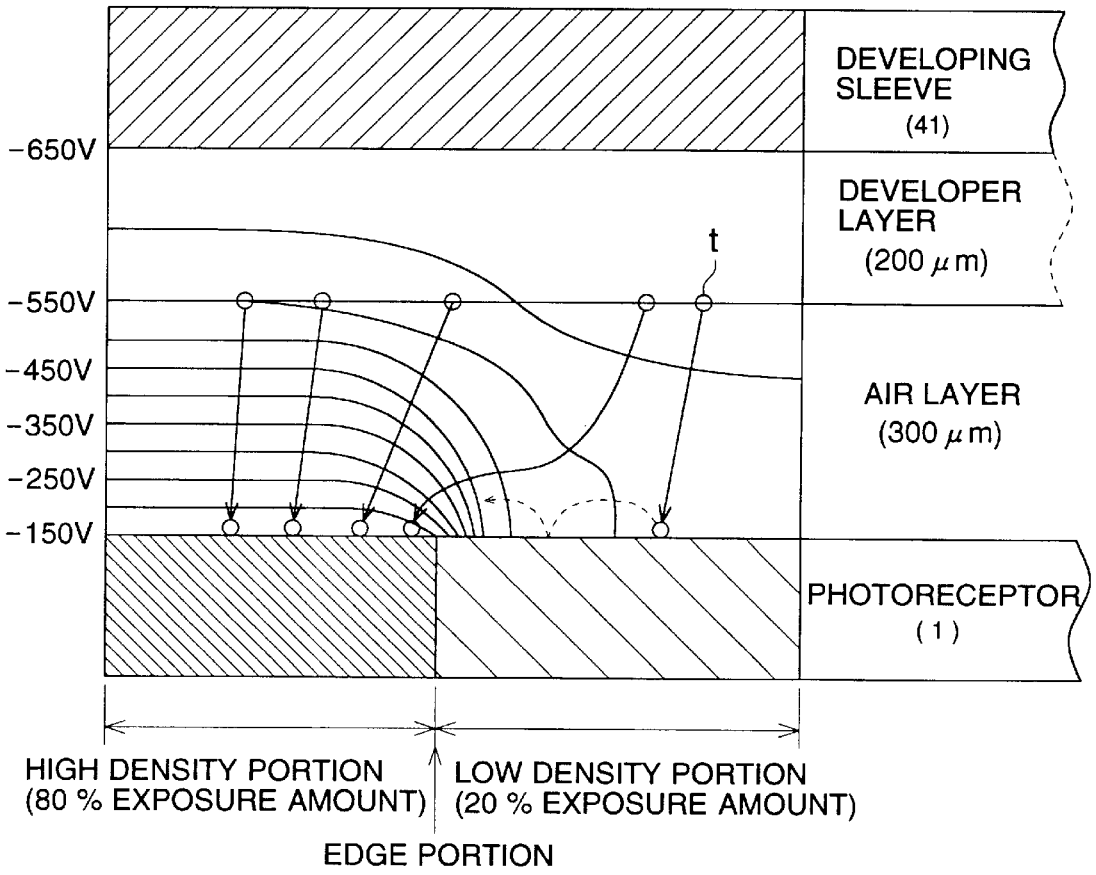
FIG. 10 is an enlarged typical view showing electric lines of force and toner movement in a developing area.

In the problem to be solved by the present invention, absorption and white loss by the behavior of toner are described using FIG. 10, however, herein, the behavior of toner due to the difference between the continuous wave and blank pulse will be described.

In FIG. 4, when the continuous wave shown by a solid line and a dashed line is applied onto the developing sleeve, the direction of electric field is changed every half cycle of AC voltage, and thereby, the movement direction of toner t is changed each time. Therefore, flying speed of toner in the vicinity of a changing point of the movement direction of toner t is decreased, toner t easily moves along the electric line of force shown in FIG. 10, an adhered amount of toner on the high density portion side of an edge portion is increased, and absorption is generated. Due to this absorption, an adhered amount of toner on the low density portion side of the edge portion is reduced, and white loss is generated.

Further, when the continuous wave is applied onto the developing sleeve, because toner t frequently bounds on the image carrier, white loss is more easily generated.

In FIG. 4, when the blank pulse shown by a solid line is applied onto the developing sleeve, the movement direction of toner t is not changed in the blank portion as compared to the case of continuous wave, and attenuation of flying speed of toner is smaller.

As the result, in the blank portion, toner t hardly moves along the curved electric line of force, and the toner t easily adheres to the low density portion also, thereby, absorption can be prevented. Further, in the blank portion, bounding of toner t can also be suppressed on the image carrier, thereby, white loss can be prevented.

When the average toner particle size by volume is small, that is, smaller than 10 $\mu$m, the absorption and white loss are frequently generated, and the present inventor has discovered that, in the image forming apparatus in which such the particle size of toner is used, it is very effective to apply the blank pulse onto the developing sleeve.

When toner diameter is large (for example, particle size is 15 $\mu$m), toner adheres to the latent image in the developing area, thereby, the latent image potential of the image portion is easily saturated. When the latent image potential is saturated, no more toner adheres to the latent image, there is no difference of the adhered amount of toner between the inside of the area of high density portion, in which the latent image potential is large, and the edge portion, thereby, absorption hardly occurs. Further, also onto the edge portion of the area of low density portion, in which the latent image potential is small, a predetermined amount of toner adheres, thereby, white loss hardly occurs.

As described above, when the blank pulse is applied, it is known that absorption and white loss can be prevented. However, in the blank portion in which application of the AC voltage is stopped, the AC voltage to trigger the toner to be separated from the developing sleeve surface is not applied, therefore, the separated amount of toner is decreased, and the developability (toner adherence property) is totally lowered (by 10–20%) as compared to the continuous waveform portion having no blank portion, which is a problem.

Accordingly, the present inventor has considered a developability lowering prevention method for the blank pulse.

FIGS. 5(*a*) and 5(b) are views showing the conventional developing bias voltage waveforms and image defects.

FIG. 5(*a*) is a typical view showing that, in the developing area, yellow toner Yt on the developing sleeve 41Y flies and adheres onto the peripheral surface of the photoreceptor 1 by the aid of AC voltage $V_{AC}$ and DC voltage $V_{DC}$ which are applied onto the developing sleeve 41Y.

The AC voltage $V_{AC}$ and DC voltage $V_{DC}$ are superimposed and applied onto the developing sleeve 41Y. When the AC voltage $V_{AC}$ is 2800 V and the DC voltage $V_{DC}$ is −600 V, the superimposed voltage changes from the range of +800 V [(+1400 V)+(−600 V)] to −2000 V [(−1400 V)+(−600 V)].

When the latent image potential $V_L$ of the image portion on the photoreceptor 1 is high density of −50 V, at the time of development by the developing unit 4Y, yellow toner Yt flies from the developing sleeve 41Y surface, whose potential is −2000 V, onto the photoreceptor 1 surface on which the latent image potential $V_L$ of the image portion is −50 V, by the aid of the DC voltage $V_{DC}$ of −600 V (arrowed direction in the drawing).

In order to increase the toner adhered amount onto the photoreceptor 1, when the AC voltage value $V_{AC}$ while the AC bias voltage is applied, is increased from 2800 V to 3800–4800 V, the peeling-off force to peel off toner from carrier is increased, thereby, the toner adhered amount onto the developing sleeve 41 can be increased. However, in such the method, the voltage difference between the developing sleeve 41 and the photoreceptor 1 is periodically increased, and the voltage difference from the latent image potential $V_L$ (−50 V) of the image portion is increased, discharge breakdown (lightning phenomena) is generated between the developing sleeve 41Y and the photoreceptor 1, and a ring-like crater, so-called a ring mark, is generated on the photoreceptor 1. Accordingly, there is a limit in that the toner adhered amount is increased by increasing the AC voltage value $V_{AC}$.

FIG. 5(*b*) is a typical view showing that, in the developing area when a plurality of toner images are superimposed and formed on the photoreceptor 1, the yellow toner Yt previously formed on the photoreceptor 1 is peeled off from the photoreceptor 1 and adhered again onto the developing sleeve 41.

When a magenta image is developing processed by the developing unit 4M, the yellow toner Yt is adhered onto the photoreceptor 1 by the preceding yellow image forming process of charging, exposing, and developing. At the time of developing processing of the magenta image by the developing unit 4M, when the AC voltage $V_{AC}$ is increased as described above, the force to peel off the yellow toner Yt adhered onto the photoreceptor 1 whose re-charged potential is −750V, from the photoreceptor 1, is also increased; the yellow toner Yt is peeled off from the developing sleeve 41Y by the AC voltage $V_{AC}$ and the DC voltage $V_{DC}$ applied onto the developing sleeve 41M, and further flies toward the developing sleeve 41M whose potential is +800 V; and sometimes the yellow toner Yt is mixed into the magenta toner Mt on the developing sleeve 41M (hereinafter, this phenomenon is called peeling).

Summing up the above description, when the AC voltage $V_{AC}$ is increased, the toner adhered amount (developability)

is increased, however, when the voltage exceeds a certain value, (1) the discharge breakdown (lightning phenomenon) is generated, and the photoreceptor 1 is damaged, or (2) in the image forming apparatus in which a plurality of toner images are superimposed on the photoreceptor 1, the peeling is generated and different color toner mixture occurs. Accordingly, in order to increase the toner adhered amount (developability), it is necessary to prevent the discharge breakdown, and to suppress generation of the peeling.

As the result of deep consideration, the present inventor has discovered that, when a waveform of the applied portion of the AC voltage with the blank pulse waveform is made a waveform which is asymmetrical with respect to any point in one cycle of the AC voltage, the developability can be prevented from decreasing in the bank pulse portion, (hereinafter, the waveform is called asymmetric wave pattern).

Figure 6:
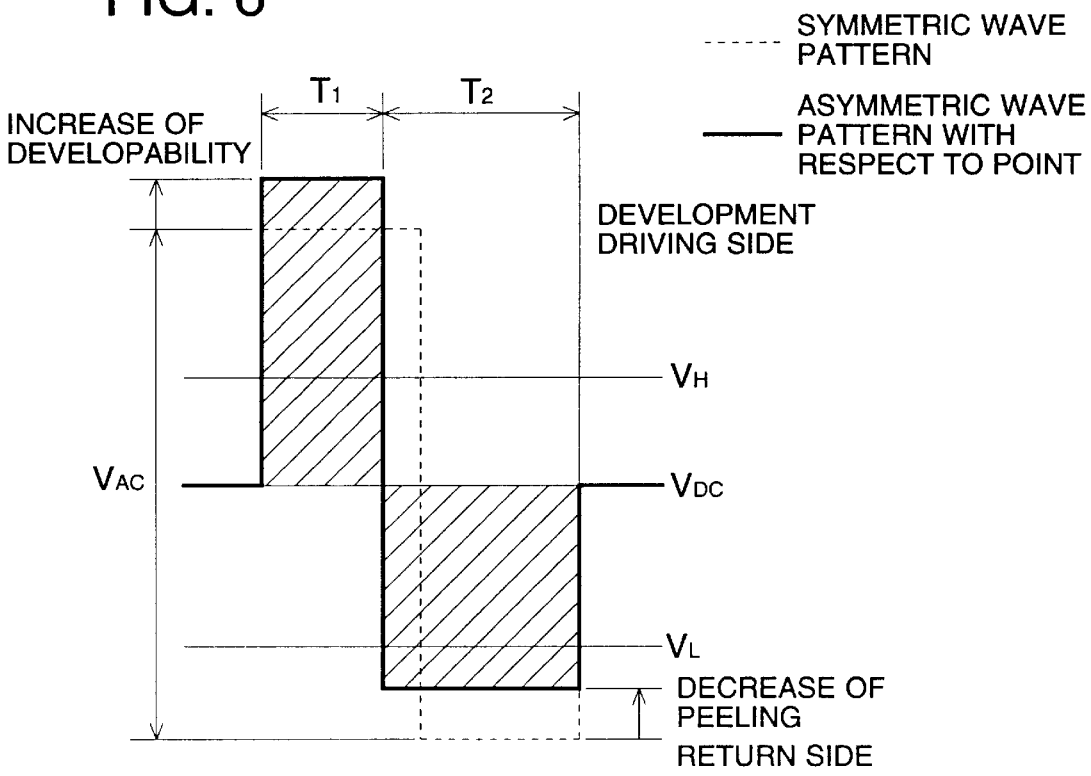
FIG. 6 is a view showing a waveform, which is asymmetrical with respect to any point, of developing bias voltage according to the present invention.

FIG. 6 is a view showing an asymmetric wave pattern of the developing bias voltage. In the drawing, a dashed line shows a symmetric wave pattern, and a solid line shows an asymmetric wave pattern according to the present invention. This wave pattern is a waveform having no symmetrical point in one cycle of the AC voltage, that is, an asymmetric wave pattern. Preferably, this asymmetric wave pattern is formed as follows: an integral value on the development driving side in which toner is moved from the developing sleeve 41 onto the photoreceptor 1 (an area of the upper side hatched portion in the drawing) and an integral value on the returning side in which toner is moved from the photoreceptor 1 to the developing sleeve 41 side (an area of the lower side hatched portion in the drawing) are made equal to each other and a predetermined value (the effective voltage level is constant); and an absolute value of the difference between a peak value of the asymmetric wave pattern and a DC voltage value applied effectively is made different on the higher side of the DC voltage and on the lower side thereof. A ratio of the application voltage and application time is changed.

Symbol $T_1$ shown in the drawing is the application time on the development driving side, and $T_2$ is the application time on the returning side. In this connection, in the waveform shown in the drawing, the duty ratio: $T_2/(T_1+T_2)$ is set at 0.6 ($T_2>T_1$). Further, it is desirable that this effectively applied DC voltage ($V\acute{i}_{DC}$) is equal to the practically applied DC voltage $V_{DC}$.

As shown in FIG. 6, when the waveform of the AC voltage of the developing bias voltage is the asymmetric wave pattern, the absolute value of the applied voltage on the development driving side is increased as compared to the symmetric wave pattern, therefore, the developability lowered in the blank portion can be compensated for by the AC voltage application portion, thereby, the toner amount adhered from the developing sleeve 41 onto the photoreceptor 1 is totally increased, and the developability is increased. In addition to that, the absolute value of the application voltage on the returning side is also decreased, thereby, the peeling can be suppressed.

The comparison of developability of the symmetric blank pulse wave pattern to that of the asymmetric blank pulse wave pattern will be shown as follows. In this case, each value is set as follows: charging voltage $V_H$ of the photoreceptor 1=−750 V, latent image potential $V_L$ on the photoreceptor 1=−50 V, DC voltage $V_{DC}$=−600 V, the closest proximity distance d between the photoreceptor 1 and the developing sleeve 41=0.57 mm, developer conveyance amount DWS of the developing sleeve 41=9 mg/cm$^2$, and frequency f=6 kHz. Further, voltage for 2 wave patterns of the pulse portion, and after that, voltage for 2 wave patterns of blank portion are applied.

(1) Symmetric blank pulse wave pattern development: in this case, the maximum AC voltage $V_{AC}$ with no-peeling phenomenon=2.4 kV, and the toner adhered amount onto the photoreceptor 1 (M/A) is 0.56 mg/cm$^2$.

(2) Asymmetric blank pulse wave pattern development when the duty ratio: $T_2/(T_1+T_2)$ is set at 0.6: in this case, the maximum AC voltage $V_{AC}$ with no-peeling phenomenon=2.6 kV is obtained; and the toner adhered amount onto the photoreceptor 1 is increased to 0.78 mg/cm$^2$.

The waveform of the pulse portion of the blank pulse shown in FIG. 4 is made to be an asymmetric wave pattern (asymmetric blank pulse), thereby, lowering of the developability, which is a problem in the blank pulse, can be suppressed, and by suppressing the lowering of the developability, the potential of the high density portion is easyly saturated, and accordingly, there also be a effect that the absorption and white loss hardly occur.

Figure 7:
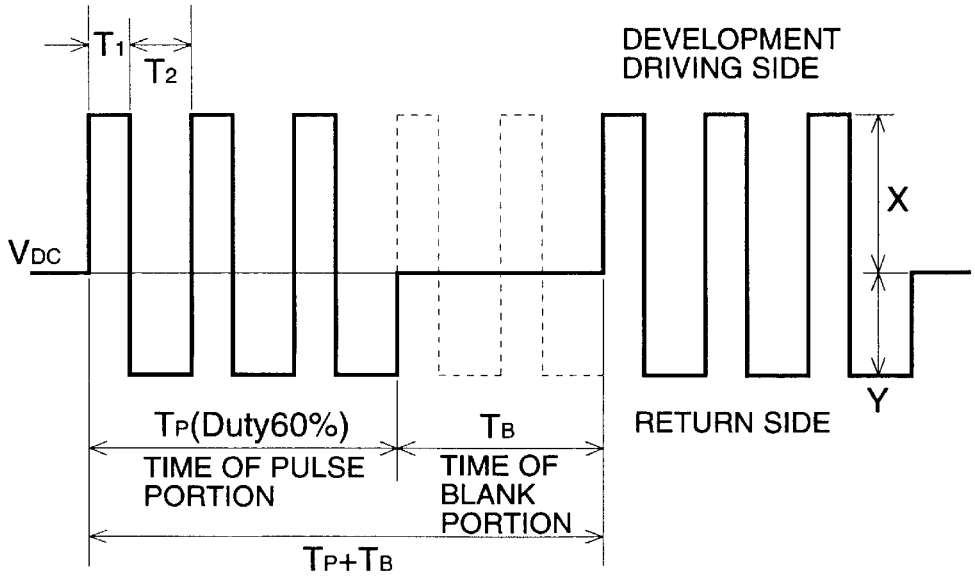
FIG. 7 is a view showing a blank pulse waveform, which is asymmetrical with respect to any point, of developing bias voltage according to the present invention.

FIG. 7 is a view showing an example of the asymmetric blank pulse wave pattern of the developing bias voltage. In the drawing, a dashed line shows the continuous wave pattern, and a solid line shows the asymmetric blank pulse wave pattern.

Incidentally, the charging potential $V_H$, latent image potential $V_L$, DC voltage $V_{DC}$, the most proximity distance d, developer conveyance amount DWS, and frequency f are the same as those values set above.

When the asymmetric blank pulse is adopted, the toner adhered amount (M/A) onto the photoreceptor 1 is increased by increasing the ratio of application time of the AC voltage to the blank time. For example, when the time of pulse portion is set to 2 from 1, to the time 1 of the blank portion, the toner adhered amount (M/A) is increased from 0.7 mg/cm$^2$ to 0.8 mg/cm$^2$. Incidentally, the review of the toner adhered amount (M/A) onto the photoreceptor 1 is conducted such that the toner amount (weight, mg) per unit area (cm$^2$) adhered onto the photoreceptor 1 is measured by a balance.

When the time of the blank portion is 1, and the time of the pulse portion $T_P$ is 2–3, the absorption is less than 1 line (170 $\mu$m) of 150 LPI (line/inch).

It is preferable that the ratio of the developer conveyance amount DWS (mg/cm$^2$) and the closest proximity distance d(mm) between the developing sleeve 41 and the photoreceptor 1 satisfies the following relationship.

$$5<(DWS/d)<40$$

The developer conveyance amount (DWS) means a conveyance amount of the developer conveyed to the developing area by the developing sleeve 41, and its review is conducted such that the developer on the developing sleeve 41 surface is collected by tape for unit area, and the weight per unit area of the developer is measured by a balance.

Further, the present inventor forms a plurality of images under various conditions that changes of the maximum electric field Emax ($=(\frac{1}{2}V_{AC}+|V_{DC}|-|V_L|)/d$) of moving (flying) direction of the developer (toner) from the developing sleeve 41 to the photoreceptor 1 when the AC voltage $V_{AC}$ is changed, and changes of the ratio of the pulse portion $T_P/(T_P+T_B)$ when time $T_P$ of the pulse portion and time $T_B$ of stop portion by the asymmetric blank pulse are changed, are combined, and these images are reviewed and the development appropriate area in which an increase of the toner adhered amount and lowering of the absorption phenomenon by the asymmetric blank pulse can be attained, is empirically confirmed.

FIGS. 8(*a*)–8(d) are characteristic views showing limits of development appropriate areas in the correlation of the maximum electric field Emax (kV/m) to the ratio of the pulse portion $T_P/(T_P+T_B)$ when frequency f of the pulse portion is set to predetermined values.

Incidentally, as the image forming apparatus according to the present invention, Konica KL-2010 color laser printer (made by Konica) for experimental purpose is used, and the outer diameter of the photoreceptor 1 is ϕ100 mm, and the outer diameter of the developing sleeve 41 is ϕ18 mm.

In the experiment in FIGS. 8(*a*)–8(d), the following values are set: the closest proximity distance d between the developing sleeve 41 and the photoreceptor 1=0.5 mm, DC voltage $V_{DC}$=−600 V, photoreceptor charging potential $V_H$=−750 V, and latent image potential of the image portion $V_L$=−50 V.

In this connection, DWS=11.6 mg/cm$^2$, d=0.5 mm, and then, (DWS/d) is 23.2.

Initially, frequency of the pulse portion is set at f=4 kHz; and while Duty and $V_{AC}$ are being changed, Emax and $T_P/(T_P+T_B)$ are appropriately selected and set respectively and developed; and as the result of evaluation of the absorption generated in the primary scanning direction, white loss generated in the subsidiary scanning direction, and toner adhered amount, these are all satisfactory in a right side area of the line A as shown in FIG. 8(*a*).

For example, when $V_{AC}$=2600 V, and Duty=0.6, then, the maximum electric field Emax is, Emax=(2600×0.6+600−50)/0.5=4.22 (kV/m).

Emax=2.6 [kV/m] is set, and when Duty is variously changed in the range of 0.5–0.9, variations of $V_{AC}$ are shown as follows:

When Duty is 0.5, $V_{AC}$=1500 V, when Duty is 0.6, $V_{AC}$=1250 V, when Duty is 0.7, $V_{AC}$=1071 V, when Duty is 0.8, $V_{AC}$=938 V, when Duty is 0.9, $V_{AC}$=833 V.

That is, when ratio of the pulse portion is 0.9 and $V_{AC}$=833 V, then, Emax=2.6 8 (kV/m). Further, when Duty is 0.5 and $V_{AC}$=1500 V, then, Emax=2.6 (kV/m).

In the evaluation of the absorption, when one line (170 μm) of 150 LPI (line/inch) is missed in the boundary portion between 20% and 100% of the exposure amount on the photoreceptor 1, it is judged to be the image defect.

In the same manner, when frequency of the pulse portion f=6 kHz, all of these are satisfactory in the right side area of the line B as shown in FIG. 8(*b*).

When frequency of the pulse portion f=8 kHz, all of these are satisfactory in the right side area of the line C as shown in FIG. 8(*c*).

When frequency of the pulse portion f=10 kHz, all of these are satisfactory in the right side area of the line D as shown in FIG. 8(*d*).

From the above results, when the development appropriate area, in which an increase of toner adhered amount and lowering of absorption phenomenon by the asymmetric blank pulse can be attained, is expressed by the approximate expression using the maximum electric field Emax, ratio of the pulse portion $T_P/(T_P+T_B)$, and frequency of the pulse portion as parameters, the following expression can be obtained:

$$T_P/(T_P+T_B)>(-4\ \text{Emax})+11.3+0.4(f-4): \quad (1)$$

In the same manner, FIGS. 9(*a*)–9(d) are characteristic views showing the limit of the development appropriate area in correlation of the maximum electric field Emax (kV/m) to the ratio of pulse portion $T_P/(T_P+T_B)$, when the frequency of the pulse portion f is set to a predetermined value.

Initially, frequency of the pulse portion is set at f=4 kHz, and Emax and $T_P/(T_P+T_B)$ are appropriately selected and set respectively and developed, and as the result of evaluation of the absorption generated in the primary scanning direction, white loss generated in the subsidiary scanning direction, and toner adhered amount, these are all satisfactory in a left side area of the line E as shown in FIG. 9(*a*).

In the evaluation of the absorption, when one line (170 μm) of 150 LPI (line/inch) is missed in the boundary portion between 20% and 100% of the exposure amount on the photoreceptor 1, it is judged to be the image defect.

For example, when the ratio of the pulse portion is 0.1, the maximum electric field Emax is 4.70 (kV/m) at $V_{AC}$=2000 V, and Duty=0.9.

Emax=4.70 (kV/m) is set, and when Duty is variously changed in the range of 0.5–0.9, variations of $V_{AC}$ are shown below.

When Duty is 0.5, $V_{AC}$=3600 V, when Duty is 0.6, $V_{AC}$=3000 V, when Duty is 0.7, $V_{AC}$=2571 V, when Duty is 0.8, $V_{AC}$=2250 V, when Duty is 0.9, $V_{AC}$=2000 V.

That is, at Duty is 0.9, when $V_{AC}$=2000 V, Emax=4.70 (kV/m). Further, at Duty is 0.5, when $V_{AC}$=3600 V, Emax=4.70 (kV/m).

In the same manner, when frequency of the pulse portion f=6 kHz, all of these are satisfactory in the left side area of the line F as shown FIG. 9(*b*).

When frequency of the pulse portion f=8 kHz, all of these are satisfactory in the left side area of the line G as shown FIG. 9(*c*).

When frequency of the pulse portion f=10 kHz, all of these are satisfactory in the left side area of the line H as shown FIG. 9(*d*).

From the above results, when the development appropriate area, in which an increase of toner adhered amount and lowering of absorption phenomenon by the asymmetric blank pulse can be attained, is expressed by the approximate expression using the maximum electric field Emax, ratio of the pulse portion $T_P/(T_P+T_B)$, and frequency of the pulse portion as parameters, the following expression can be obtained:

$$(-4\ \text{Emax})+18.9+0.4(f-4)>T_P/(T_P+T_B): \quad (2)$$

Summing up the above description, when the intermittently stopped AC component (blank pulse) is asymmetrically formed, and Emax, $T_P$, and $T_B$ are set in the appropriate range to satisfy the above expressions (1) and (2), it is effective for the absorption and white loss, and the developability can also be prevented from lowering.

Accordingly, the present inventor has further studied toner deviation in the subsidiary scanning direction when the voltage, in which the asymmetrical intermittently stopped AC component is superimposed on the DC component, is applied.

In the case where the advancing direction, speed, or the like of the image carrier and developer carrier in the developing area, are considered, when the advancing direction of the image carrier is the same as developer conveyance direction of the developer carrier, and the speed is the same, even if there is a gap in the latent image potential in the advancing direction, there is no difference of the toner adhered amount between the leading edge portion of the latent image and the trailing edge portion of the latent image.

However, the absolute adhered amount of toner is little, and a predetermined reflection density is hardly obtained.

Figure 11:
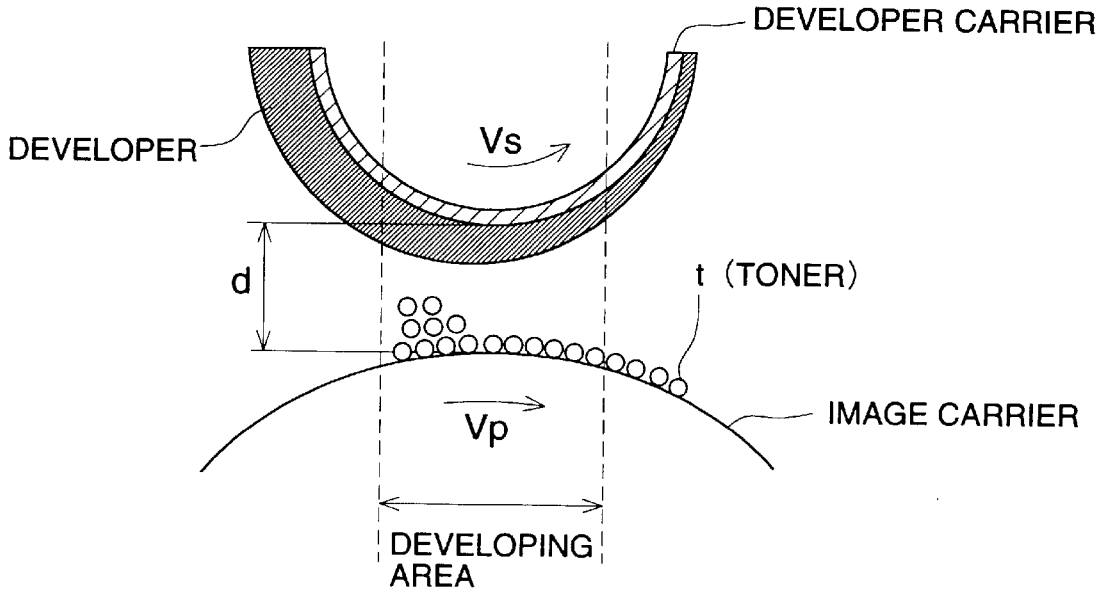
FIGS. 11(*a*) and 11(b) are a typical view showing toner adhering condition in the developing area where a photoreceptor is in close proximity to a developing sleeve, and a view typically showing toner adhered onto the photoreceptor.
Figure 11:
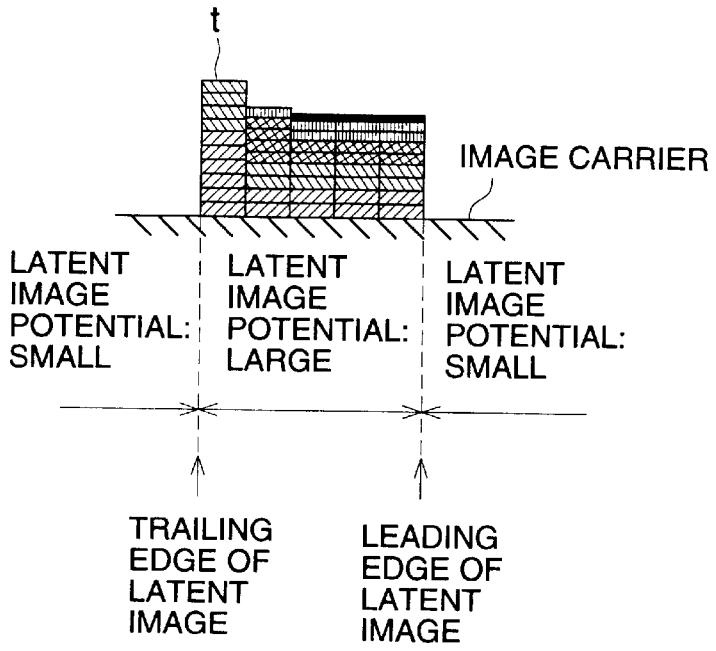

FIG. 11(*a*) is a typical view showing toner adhesion in the developing area in which the image carrier and the developer carrier are in proximity to each other. FIG. 11(*b*) is a view typically showing toner adhered onto the i mage carrier when the developing area is divided into 5 areas, and the latent image data on the image carrier is also divided in to 5 with the same distance as the developing area division.

As shown in FIGS. 11(*a*) and 11(b), when the peripheral speed Vs of the develop er carrier is larger than the peripheral speed Vp of the image carrier (Vs>Vp), the reflection density of the toner image can be increased, however, more than predetermined amount of toner t adheres onto the trailing edge portion (1) of the latent image in the area having larger latent image potential.

This is for the reason that generally, toner of the developer is consumed in the developing area, and unconsumed developer enters the trailing edge portion of the latent image, therefore, the supply amount of toner t is increased.

The toner adhered amount from the trailing edge portion of the latent image to the leading edge portion of the latent image is suddenly reduced, thereby, a change of color is easily conspicuous particularly in the case of secondary color superimposition.

Further, toner hardly adheres onto the trailing edge (2) of the latent image in the small latent image potential area (highlight portion).

This is for the reason that the developer on the developer carrier enters the small latent image potential area after toner has been consumed in the large latent image potential area.

Figure 12:
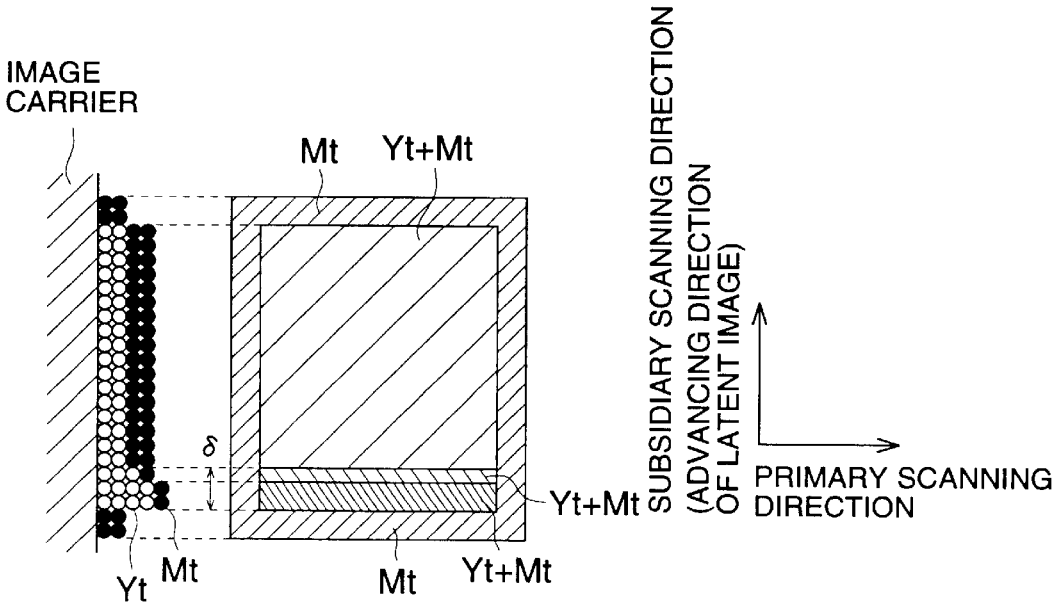
FIG. 12 is a typical sectional view and a typical plan view of 2 color toner images formed on the photoreceptor.

FIG. 12 is a typical sectional view and a typical plan view showing a condition in which yellow toner Yt and magenta toner Mt are superimposed on the image carrier, and 2-color toner image is formed.

The central portion on which the first color of yellow toner Yt and the second color of magenta toner Mt are uniformly superimposed, is uniformly red.

However, as described above, the trailing edge of yellow toner Yt in the subsidiary scanning direction, yellow toner Yt being initially formed on the image carrier, has the large adhered amount of yellow toner Yt, and the toner layer potential is high, therefore, the adhered amount of magenta toner Mt which is superimposed on the yellow toner Yt, is lowered.

Accordingly, on the trailing edge portion, the density of yellow toner Yt is high, and the density of magenta toner Mt is low, therefore, the color on the portion changes to yellowish red.

The color change portion of the secondary color in which the secondary color of the magenta toner Mt is little, is referred to as the secondary deviation width, and expressed by δ in the drawing.

As described above, it is necessary that at the latent image potential gap between the leading edge portion of the latent image and the trailing edge portion of the latent image, fluctuation in the toner adhered amount is reduced, and the secondary color change is made hardly conspicuous.

Accordingly, the rotating direction of the image carrier and developer carrier in the developing area is considered.

Figure 13:
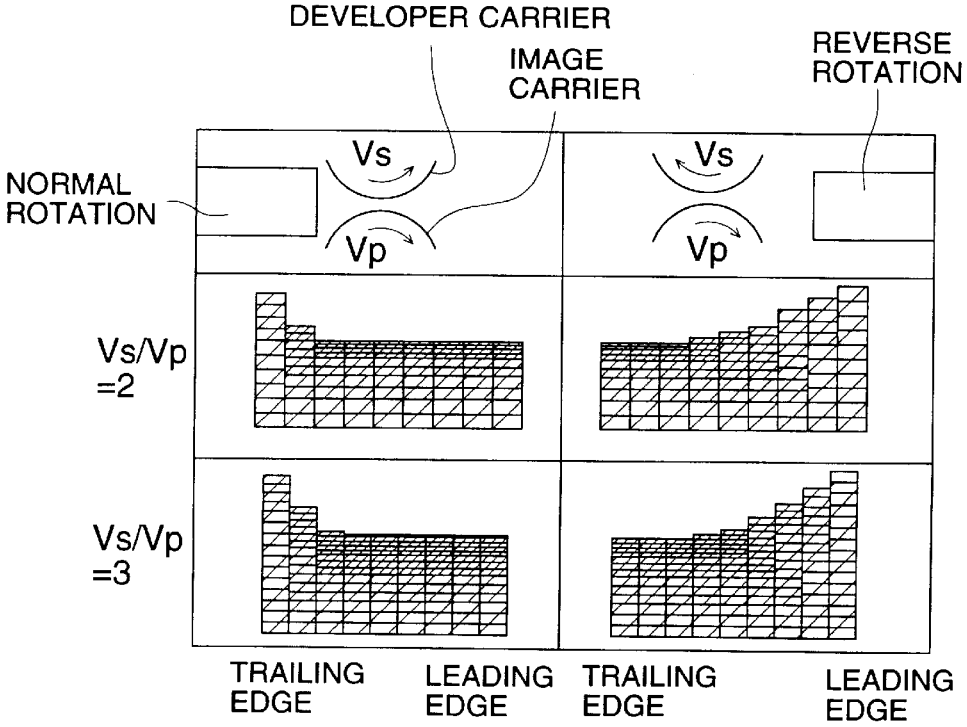
FIG. 13 is a typical view explaining an adhered amount of toner on the photoreceptor drum.

FIG. 13 is a typical view explaining the toner adhered amount on the image carrier when the developing area is divided into 9, and the latent image data on the image carrier is also divided into 9 with the same distance as the developing area division.

When the developer conveyance direction of the developer carrier is the same (normal rotation) as the advancing direction of the image carrier, the toner adhered amount on the trailing edge portion of the latent image is increased as described above.

Further, the larger the ratio of the peripheral speed Vs of the developer carrier and the peripheral speed Vp of the image carrier (Vs/Vp) is, the larger is the deviation width on the trailing edge portion of the latent image.

On the other hand, when the developer conveyance direction of the developer carrier is reverse (reverse rotation) to the advancing direction of the image carrier, the toner adhered amount on the leading edge portion of the latent image is increased.

This is for the reason that unconsumed developer enters the leading edge portion of the latent image, and the toner supply amount is increased. In toner adhered amount, the deviation width in the case of reverse rotation is wider than that in the case of normal rotation.

Conditions of fluctuation of the toner adhered amount are different depending on the normal rotation and reverse rotation, however, there is fluctuation of the toner adhered amount on the edge portion of th e latent image.

Accordingly, the present inventor increases the toner supply amount from the developer carrier, and increases the absolute adhered amount in the large latent image potential area, thereby, the latent image potential is made easily saturated.

According to this, it is suppressed that toner excessively adheres onto the edge portion, and further, white loss in the low latent image potential area on the edge portion can be suppressed.

Further, in the case where the toner supply amount is increased, when the developing condition that the adhered amount is equal to that of the case in which the supply amount is not increased, is selected by comparison (it is assumed that a decrease of the latent image potential is the same), the development efficiency can be lowered.

Accordingly, decreasing inclination of the toner amount in the developer from the image carrier inlet side to the outlet side in the developing area is more slowly advanced, therefore, it can be prevented that the adhered amount is suddenly increased at the edge portion.

It is confirmed how much toner supply amount is appropriate, by the following experiment.

EXAMPLE 1

Next, the first example of the present invention will be described.

Development is carried out under the following developing conditions and image formation is carried out. The color printer shown in FIG. 1 is used for the image formation, and the developing apparatus shown in FIGS. 2 and 3 is used for development. The following conditions are set, the toner conveyance supply amount is made variable, development is carried out by the above-described operations, and images are evaluated.

Incidentally, as the image forming apparatus according to the present example, Konica KL-2010 color printer (made by Konica (Co.)) modified machine is used, and the outer diameter of the developing sleeve 41 is ϕ18 mm, and the outer diameter of the photoreceptor drum 1 is ϕ100 mm.

Setting conditions of the development processing are as follows.

The closest proximity distance d between the photoreceptor 1 and the developing sleeve 41=0.55 mm;

Charging potential $V_H$: −750 V;

DC voltage $V_{DC}$ applied on the developing sleeve 41: −600 V;

Latent image potential $V_L$ on the photoreceptor 1 $V_L$: −50 V, $V_{AC}$p-p: 2.5 V;

Yellow latent image PWM: 50%, magenta latent image

PWM: 100% superimposition.

Evaluation of the toner conveyance supply amount and developability is shown in Table 1.

TABLE 1

| No. | | Toner conveyance supply amount ($mg/cm^2$) | Duty (%) $T_2/(T_1 + T_2)$ | B/P ratio $T_p/(T_p + T_B)$ | Secondary deviation width δ (mm) | Color shift of edge portion | Reflection density |
|---|---|---|---|---|---|---|---|
| 1 | Asymmetric wave Blank pulse Developing sleeve: reverse rotation | 0.9 | 60 | 0.5 | 5 | A | A |
| 2 | Asymmetric wave Blank pulse Developing sleeve: reverse rotation | 0.6 | 60 | 0.5 | 5 | A | A |
| 3 | Asymmetric wave Blank pulse Developing sleeve: reverse rotation | 0.35 | 60 | 0.5 | 5 | A | A |
| 4 | Asymmetric wave Blank pulse Developing sleeve: reverse rotation | 0.28 | 60 | 0.5 | 5 | B | C |
| 5 | Asymmetric wave Blank pulse Developing sleeve: reverse rotation | 0.25 | 60 | 0.5 | 5 | C | C |
| 6 | Symmetric continuous wave Developing sleeve: reverse rotation | 0.35 | 50 | 1 | 5 | B | A |

In Table 1, in each of No. 1–6, the developing sleeve 41 is rotated in reverse to the rotating direction of the photoreceptor drum 1 in the developing area as shown in FIG. 3.

Further, the waveform in No. 1–5 is the asymmetric wave as shown in FIG. 7, and is the blank pulse wave pattern having stopping portion. No. 6 is the conventional symmetric continuous wave pattern.

Toner conveyance supply amount shows the toner amount per unit area ($mg/cm^2$) on the developing sleeve 41, and in the case of 2-component developer, it is only the toner amount except carrier. The toner conveyance supply amount is determined by toner density of the developer and the developer layer thickness by the developer layer regulating member 43. For example, the toner conveyance supply amount of No. 1 in Table 1 means that toner of 9% toner density is included in 10 mg developer, and the toner conveyance supply amount is 10 mg×0,09=0.9 mg.

Duty in Table 1 expresses the shape of the waveform width by $T_2/(T_1+T_2)$ as shown in FIG. 6, and the asymmetric wave pattern of No. 1–5 is $T_2/(T_1+T_2)=60$ (%), and the symmetric continuous wave pattern of No. 6 is 50 (%).

The B/P ratio in Table 1 is expressed by $T_P/(T_P+T_B)$ as shown in the blank pulse in FIG. 7, and the asymmetric wave pattern of No. 1–5 is $T_P/(T_P+T_B)=0.5$, that is $T_P=T_B$. In the symmetric continuous wave pattern of No. 6, $T_B=0$, and B/P ratio is 1.

The secondary deviation width in Table 1 means the secondary color change portion in which the secondary color of magenta toner Mt is little on the primary color of yellow toner Yt as shown in FIG. 12.

The color shift of the edge portion in Table 1 is a shift of color by a change of toner adhered amount generated at a boundary portion (edge portion)at which yellow toner Yt and magenta toner Mt are superimposed on each other as shown in FIG. 12.

The toner conveyance supply amount, duty and B/P ratio are set as described above and development process is carried out, and formed color images are evaluated.

The secondary deviation width δ is seen in each of No. 1–6 with 5 mm width.

The color shift of the edge portion is judged by visual observation, and the image with no color shift is marked by A, the image with small color shift is marked by B, and the image with large color shift is marked by C.

In each of No. 1–3, the toner conveyance supply amount is more than 0.35 $mg/cm^2$, there is no color shift at the edge portion, and a good color image is obtained. In No. 4, the toner conveyance supply amount is not more than 0.35 $mg/cm^2$, and the color shift at the edge portion is generated. Further, when the toner conveyance supply amount is less than 0.25 $mg/cm^2$, the color shift is conspicuously generated (No. 5). In No. 6, the toner conveyance supply amount is 0.35 $mg/cm^2$, however, because of the symmetric continuous wave pattern development bias voltage, the absorption and white loss are generated, and some color shift is generated.

In the reflection density in Table 1, the toner image formed by the developing apparatus according to the present example, is measured by a reflection densitometer, and a good image with reflection density more than 1.4 is judged by A, and a image with reflection density not more than 1.4 is judged by C.

In each of No. 1–3, the toner conveyance supply amount is more than 0.35 $mg/cm^2$, there is no color shift at the edge portion, and a good color image is obtained. In No. 4, the toner conveyance supply amount is not more than 0.35 $mg/cm^2$, and the color shift at the edge portion is generated. Further, when the toner conveyance supply amount is less than 0.25 $mg/cm^2$, the color shift is conspicuously generated (No. 5). In No. 6, the toner conveyance supply amount is 0.35 $mg/cm^2$, however, because the symmetric continuous wave pattern development bias voltage is applied, there is color shift.

In this connection, when the toner conveyance supply amount is more than 0.35 $mg/cm^2$, and the more it is, the color shift or reflection density at the edge portion is the more improved, however, when it is too much, development failure is generated due to developer contact at the gap portion in the non-contact development. Accordingly, the upper limit of the toner conveyance supply amount is about 2.4 $mg/cm^2$, which corresponds to about 12% of toner density for 20 mg developer.

When these evaluation are integrated, the excellent high image quality can be obtained from No. 1–3 in which the asymmetric wave pattern (FIG. 6), blank pulse (FIG. 7), and reversely rotated developing sleeve (FIG. 13) are adopted.

That is, the developing apparatus and image forming apparatus according to the first example relate to the prevention of the absorption and white loss in the primary and subsidiary scanning direction, and increase the toner conveyance supply amount (more than 0.35 mg/cm$^2$ toner conveyance supply amount) and improve the absolute adhered amount of toner onto the large latent image potential area, thereby, the latent image potential is made easily saturated. Accordingly, excessive toner adhesion onto the edge portion is suppressed, and white loss in the low latent image potential area at the edge portion is also suppressed.

Further, in the case where the toner conveyance supply amount is increased, when the developing condition that the toner adhered amount is equal to that of the case in which the supply amount is not increased, is selected by comparison (it is assumed that a decrease of the latent image potential is the same), the development efficiency can be lowered. Accordingly, decreasing inclination of the toner amount in the developer from the image carrier inlet side to the outlet side in the developing area is more slowly advanced, therefore, it can be prevented that the adhered amount is suddenly increased at the edge portion.

Furthermore, the following object is further considered: as described above, it is necessary that in the latent image potential gap between the leading edge portion of the latent image and the trailing edge portion of the latent image, fluctuation in the toner adhered amount is reduced, and the secondary color change is made hardly conspicuous.

Accordingly, the present inventor has studied the peripheral speed Vp of the photoreceptor 1 and the peripheral speed Vs of the developing sleeve 41.

In the developing area, in the case where the rotating direction of the photoreceptor 1 and that of the developing sleeve 41 are the same, when Vs/Vp is further increased, the adhered amount ratio at the central portion, in which latent image potential is large, and at the edge portion is decreased, and the area onto which much developer adheres is increased, and increasing inclination of the adhered amount from the central portion to the edge portion is more slowly, and it becomes hardly conspicuous as the density change of the developed image.

In the same manner, in the case where the advancing direction of the photoreceptor and that of the developer carrier are reverse to each other, when Vs/Vp is further increased, the adhered amount ratio at the central portion in which latent image potential is large, and the edge portion is decreased.

When Vs/Vp is increased, the adhered amount is also increased, and it is equivalent to a fact that the latent image potential is also in easily saturable condition.

Accordingly, the developability is increased.

It is confirmed by the experiment in which range Vs/Vp should be desirably set.

The result will be shown below.

EXAMPLE 2

Next, the present invention will be explained about the second example.

The experiment is carried out as follows. Development is carried out under the following developing conditions and image formation is carried out. The image forming apparatus shown in FIG. 1 is used for the image formation, and the developing apparatus shown in FIGS. 2 and 3 is used for development. The following conditions are set, the toner conveyance supply amount is made variable, development is carried out by the above-described operations, and images are evaluated.

Incidentally, as the image forming apparatus according to the present example, Konica KL-2010 color printer (made by Konica (Co.)) modified machine, shown in FIG. 1, is used, and the outer diameter of the developing sleeve 41 is ϕ18 mm, and the outer diameter of the photoreceptor drum 1 is ϕ100 mm.

Setting conditions of the development processing are as follows.

The closest proximity distance d between the photoreceptor 1 and the developing sleeve 41=0.55 [mm];

Photoreceptor charging potential $V_H$: −750 [V];

DC voltage $V_{DC}$ applied on the developing sleeve 41: −600 [V];

Latent image potential $V_L$ on the photoreceptor 1 $V_L$: −50 [V],

AC voltage $V_{AC}$p-p applied on the developing sleeve 41: 2.5 [kV];

Yellow latent image PWM: 50%, magenta latent image

PWM: 100% superimposition.

Evaluation of the secondary deviation width δ, color shift, and reflection density at the edge portion is shown in Table 2.

TABLE 2

| No. | | Duty (%) $T_2/(T_1 + T_2)$ | B/P $T_p/(T_p + T_B)$ | Speed ratio Vs/Vp | Secondary deviation width δ (mm) | Color shift of edge portion | Reflection density |
|---|---|---|---|---|---|---|---|
| 1 | Asymmetric wave pattern Blank pulse Developing sleeve: normal rotation | 60 | 0.5 | 3 | 2.5 | A | A |
| 2 | Asymmetric wave pattern Blank pulse Developing sleeve: normal rotation | 60 | 0.5 | 2 | 2 | B | A |
| 3 | Asymmetric wave pattern Blank pulse Developing sleeve: normal rotation | 60 | 0.5 | 1 | 0.5 | A | C |
| 4 | Asymmetric wave pattern Blank pulse Developing sleeve: reverse rotation | 60 | 0.5 | 3 | 5 | AA | A |

TABLE 2-continued

| No. | | Duty (%) $T_2/(T_1 + T_2)$ | B/P $T_p/(T_p + T_B)$ | Speed ratio Vs/Vp | Secondary deviation width δ (mm) | Color shift of edge portion | Reflection density |
|---|---|---|---|---|---|---|---|
| 5 | Asymmetric wave pattern Blank pulse Developing sleeve: reverse rotation | 60 | 0.5 | 2 | 5 | A | A |
| 6 | Asymmetric wave pattern Blank pulse Developing sleeve: reverse rotation | 60 | 0.5 | 1 | 5 | C | C |
| 7 | Symmetric wave pattern Continuous wave Developing sleeve: reverse rotation | 50 | 1 | 2 | 5 | B | A |

In each of No. 1–6 in Table 2, voltage with asymmetric blank pulse wave pattern (refer to FIG. 12) is applied on the developing sleeve 41. Further, in No. 1–3, the rotating direction of the developing sleeve 41 in the developing area is the same (normal rotation)as that of the photoreceptor 1 (refer to FIG. 11(*a*)). In No. 4–6, the rotating direction of the developing sleeve 41 in the developing area is reverse (reverse direction) to that of the photoreceptor 1. In No. 7, voltage with symmetric continuous wave pattern is applied onto the developing sleeve 41.

Duty in Table 2 is expressed in FIG. 7, and the asymmetric wave pattern of No. 1–6 is $T_2/(T_1+T_2)=60\%$, that is, $T_2>T_1$. The symmetric continuous wave pattern of No. 7 is 50%, that is $T_1=T_2$.

The B/P ratio in Table 2 is expressed by $T_P/(T_P+T_B)$ as shown in the blank pulse in FIG. 7, and the asymmetric wave pattern of No. 1–6 is $T_P/(T_P+T_B)=0.5$, that is $T_P=T_B$. In the symmetric continuous wave pattern of No. 7, $T_B=0$, and B/P ratio is 1.

The speed ratio Vs/Vp in Table 2 expresses the ratio of the peripheral speed Vs [mm/sec] of the developing sleeve 41 and the peripheral speed Vp [mm/sec] of the photoreceptor 1. The speed ratio 3 of No. 1 shows the case where the developing sleeve is normally rotated, and the speed ratio 3 of No. 4 shows the case where the developing sleeve is reversely rotated. The speed ratio 2 of No. 2 shows the case where the developing sleeve is normally rotated, and the speed ratio 2 of No. 5 shows the case where the developing sleeve is reversely rotated. The speed ratio 1 of No. 3 shows the case where the developing sleeve is normally rotated, and the speed ratio 1 of No. 6 shows the case where the developing sleeve is reversely rotated. The speed ratio 2 of No. 7 shows the case where the developing sleeve is reversely rotated.

The secondary deviation width δ in Table 2 means the secondary color change portion in which the secondary color of magenta toner Mt is little on the primary color of yellow toner Yt as shown in FIG. 12.

The color shift of the edge portion in Table 2 is a shift of color by a change of toner adhered amount generated at a boundary portion (edge portion) at which yellow toner Yt and magenta toner Mt are superimposed on each other as shown in FIG. 12.

As shown in Table 2, duty, B/P ratio and speed ratio Vs/Vp are set and development processing is carried out, and the color shift of the formed color images are evaluated.

In the developing apparatus provided with the developing sleeve 41 onto which blank pule voltage with asymmetric wave pattern is applied and which is reversely rotated, as shown in No. 4–6, the secondary deviation width δ widely appears with 5 mm width on the leading edge portion of the image. In the No. 1–3 developing apparatus provided with the developing sleeve 41 onto which blank pule voltage with asymmetric wave pattern is applied and which is normally rotated, as shown in No. 1–2, the secondary deviation width δ appears with 2 mm width, smaller than the above result, on the leading edge portion of the image. The secondary deviation width δ of No. 3, which is smaller than the above result, appears with 0.5 mm width on the leading edge portion of the image.

The color shift of the edge portion is judged by visual observation, and the good image with no color shift is marked by AA, the image with little color shift is marked by A, the image with a few color shift is marked by B, and the image with large color shift is marked by C.

In No. 4 developing apparatus of the present example in which developing bias voltage with the asymmetric blank pulse wave pattern, reversely rotated developing sleeve, and speed ratio Vs/Vp=3 are adopted, there is no color shift at the edge portion, and an image with the finest hue can be obtained. Further, in No. 4 developing apparatus, the absorption and white loss are prevented from being generated, and sufficient density is obtained, further, excellent developer property and developing stability are obtained, and the high quality image can be obtained.

Next, in No. 1, No. 3 and No. 5, color shift at the edge portion is little. In No. 2 and No. 7, the image has a little color shift. In No. 6, much color shift is generated.

As to the reflection density in Table 2, the toner image formed by the developing apparatus according to the present example is measured by a densitometer, and a fine image having the reflection density more than 1.4 is judged as A, and an image having the reflection density not more than 1.4 is judged as C. As the result, No. 1–2, and No. 4–5 in which the speed ratio (Vs/Vp)>2 is adopted, are satisfactory.

When these evaluation are integrated, Nos. 1, 2, 4 and 5 in which the asymmetric wave pattern of 60% duty (refer to FIG. 6), blank pulse with B/P ratio of 0.5 (refer to FIG. 7), reverse rotation of the developing sleeve, and speed ratio (Vs/Vp)>2 are adopted, are good, and specifically, No. 4 in which the speed ratio (Vs/Vp)=3 is adopted, is excellent.

Incidentally, (Vs/Vp) larger than 2 is preferable, and the larger the (Vs/Vp) is, the more the secondary deviation width, the color shift at the edge portion and reflection density are improved. However, when the ratio is too large, the rotation speed of the developing sleeve is increased, and there is a possibility that problems occur in the mechanical durability. Accordingly, it is appropriate that the upper limit of (Vs/Vp) is about 5. When the speed ratio (Vs/Vp) of the developer carrier and the image carrier in the developing area is made more than 2, the change of the secondary color in the latent image potential gap can be made hardly conspicuous, and sufficient reflection density can be obtained, thereby, the image with excellent hue can be obtained.

The present inventor has further studied the object that it is necessary as described above to reduce the fluctuation of the toner adhered amount in the latent image potential gap and to make the color change of the secondary color hardly conspicuous, and then, a portion on the photoreceptor 1 in the closest proximity to the developing sleeve 41 is set between different magnetic poles of a plurality of magnetic poles in the magnetic roller 42.

Figure 14:
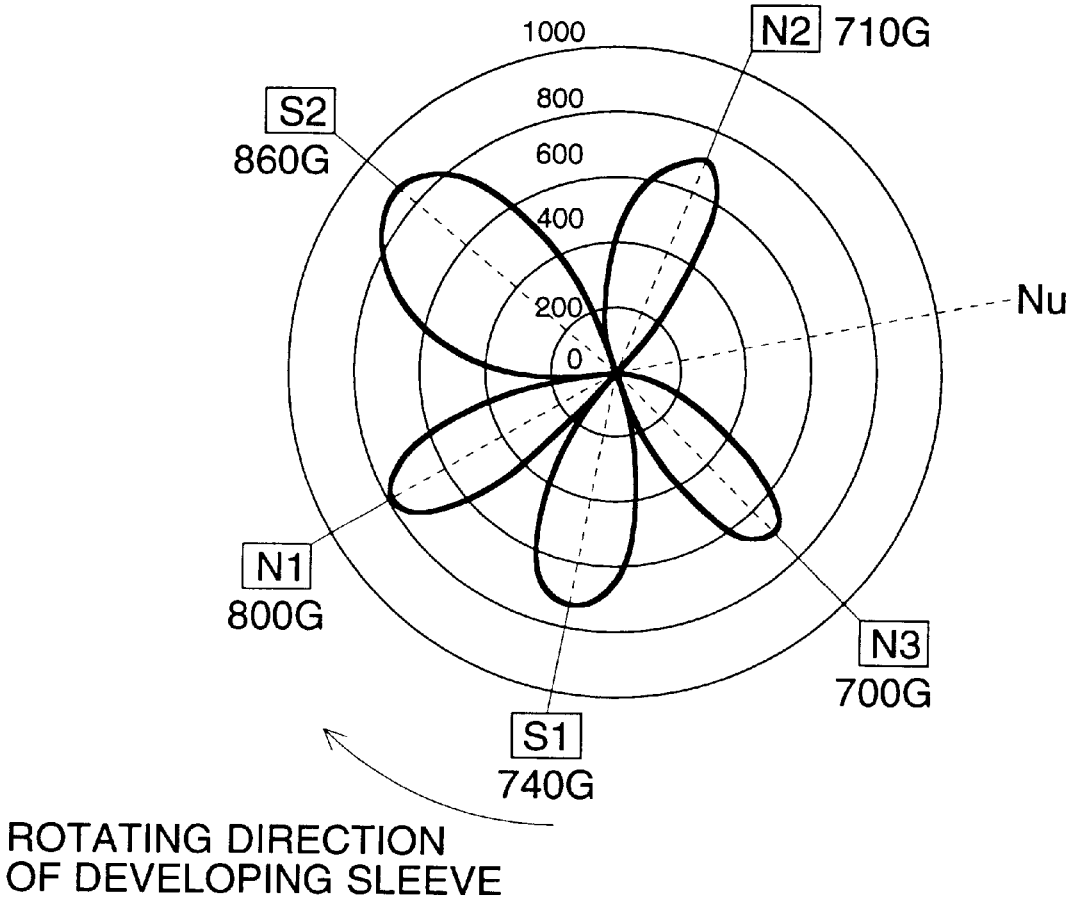
FIG. 14 is a view showing magnetic force distributions of a magnetic roller.

FIG. 14 is a view showing the distribution of magnetic force of the magnetic roller 42.

In the developing sleeve 41, the magnetic roller 42 in which a plurality of magnetic poles N1, N2, N3, S1, S2 are arranged such that N and s are alternately arranged, is fixed. In these plurality of magnetic poles, adjoining magnetic poles N2 and N3 having the same polarity form repulsive magnetic field, and remove the developer on the developing sleeve 41. The magnetic pole S1 faces the developer layer regulating member 43. An area between magnetic poles N1 and S2 is an inter-polar developing area, which will be described later.

Figure 15:
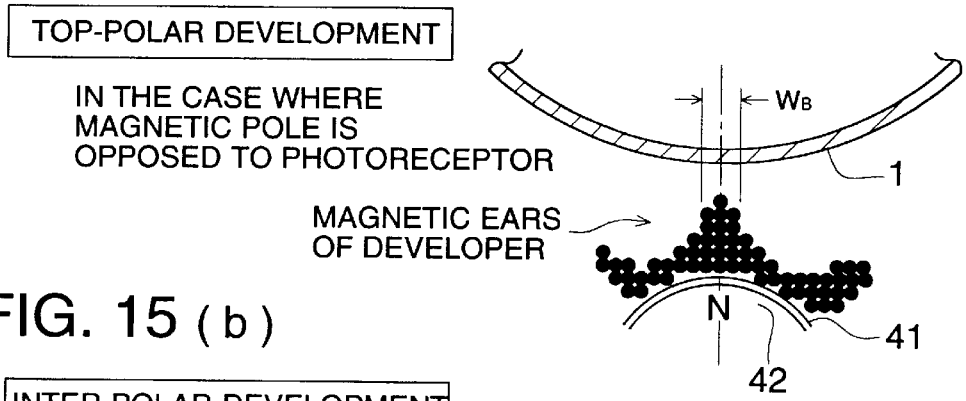
FIGS. 15(*a*) and 15(b) are typical views of the top-polar development and the inter-polar development.
Figure 15:
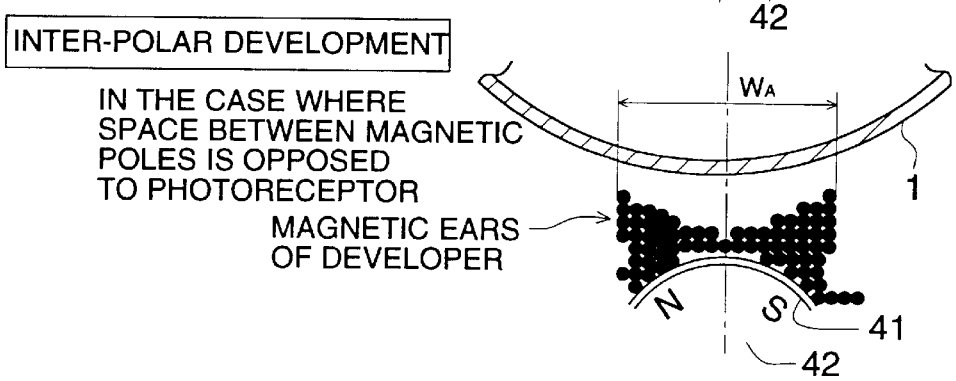

FIG. 15(*a*) is a typical view of top-polar development. In the developing area in which the peripheral surface of the photoreceptor 1 and the peripheral surface of the developing sleeve 41 are in closest proximity to each other, the magnetic pole (N) of the magnetic roller 42 is arranged facing the photoreceptor 1, and development is carried out. In the drawing, $W_B$ shows the effective width of a magnetic ear of the top-polar development.

FIG. 15(*b*) is a typical view of inter-polar development. In the developing area in which the peripheral surface of the photoreceptor 1 and the peripheral surface of the developing sleeve 41 are in closest proximity to each other, the intermediate portion of magnetic poles (N, S) of the magnetic roller 42 is arranged facing the photoreceptor 1, and development is carried out. In the drawing, $W_A$ shows the effective width of the magnetic ear of the inter-polar development.

In this connection, the magnetic pole arrangement position in the top-polar development is within the range of ±20°, preferably ±10°, with respect to the closest proximity position to the photoreceptor 1. The central position between 2 adjoining poles in the developing area in the case of the inter-polar development is within the range of ±20°, preferably ±10°, with respect to the closest proximity position to the photoreceptor 1.

Figure 16:
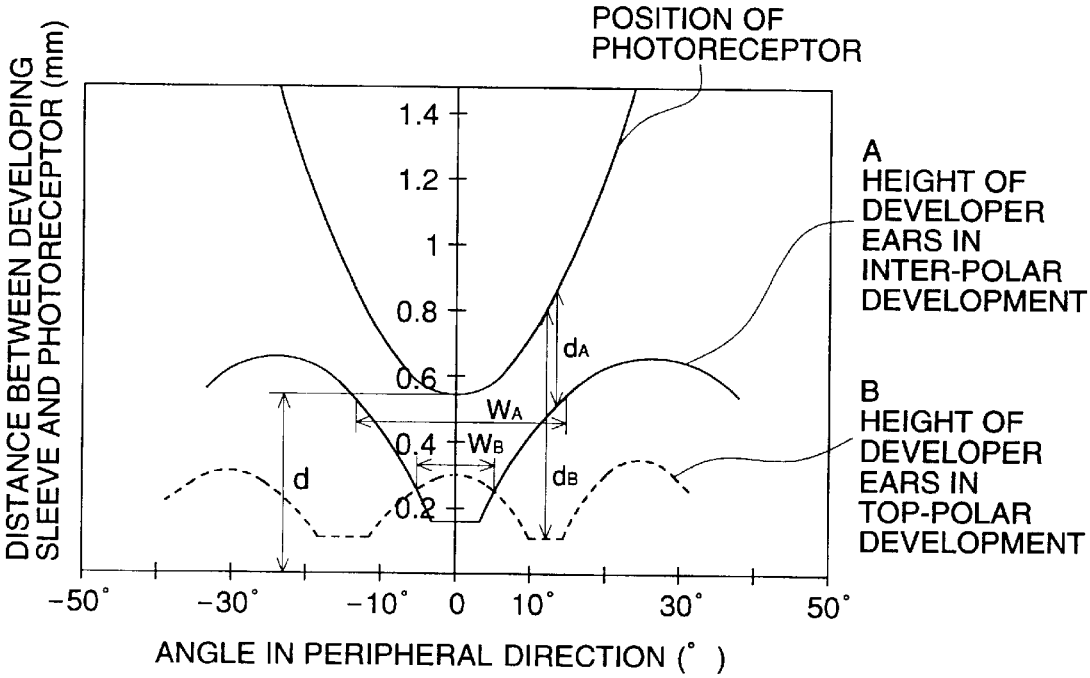
FIG. 16 is a view showing the height of magnetic ear of the developer formed on the developing sleeve and a distance between the magnetic ear and the peripheral surface of the photoreceptor.

FIG. 16 is a view showing the height of the magnetic ear of the developer formed on the developing sleeve 41 and the distance to the peripheral surface of the photoreceptor 1. In the drawing, a curve A shown by a solid line is the height of the magnetic ear of the developer formed on the developing sleeve 41 in the case of the inter-polar development. A curve B shown by a dashed line is the height of the magnetic ear of the developer formed on the developing sleeve 41 in the case of the top-polar development. The developing sleeve 41 in the case of the top-polar development lowers the height of the developer ear in the development nip center, and makes it no-contact, by changing the strength of the magnetic field, and the distribution of the magnetic field. Incidentally, the horizontal axis in the drawing shows the development angle of the peripheral surface of the developing sleeve 41, and the vertical axis shows the distance from the peripheral surface of the developing sleeve 41 to the direction of the photoreceptor 1.

The closest proximity distance d between the peripheral surface of the developing sleeve 41 and the peripheral surface of the photoreceptor 1 is set at 0.55 mm, and the height of the magnetic ear of the developer on the developing sleeve 41 is actually measured.

In the case of the top-polar development, as the developing sleeve 41 goes away from the closest proximity potion to the photoreceptor 1 toward the direction of the peripheral surface, the distance $d_B$ from the top of the magnetic ear of the developer to the peripheral surface of the photoreceptor 1 is suddenly increased.

In contrast to this, in the case of the inter-polar development, even when the developing sleeve 41 goes away from the closest proximity potion to the photoreceptor 1 toward the direction of the peripheral surface, a change of the distance $d_A$ from the top of the magnetic ear of the developer to the peripheral surface of the photoreceptor 1 is small.

Figure 17:
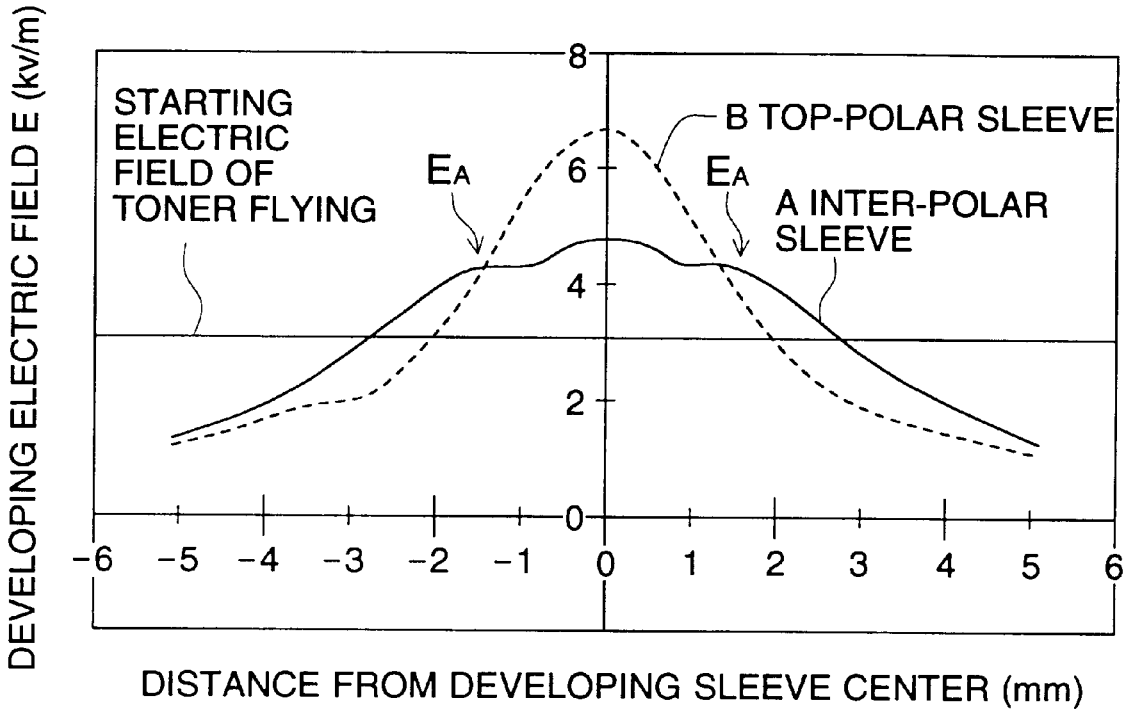
FIG. 17 is a view showing characteristics of developing electric field in the developing area.

FIG. 17 is a view showing the characteristics of development electric field E in the development area.

In the drawing, a curve A shown by a solid line is the development electric field E formed on the developing sleeve 41 in the case of the inter-polar development. A curve B shown by a dashed line is the development electric field E formed on the developing sleeve 41 in the case of the top-polar development. In this connection, the horizontal axis in the drawing shows the development length of the peripheral surface of the developing sleeve 41, and the vertical axis shows the development electric field E (kV/m) in the developing area.

When the inter-polar development and the top-polar development are compared to each other, in the inter-polar development, the development electric field E in the closest proximity position between the photoreceptor 1 and the developing sleeve 41 is small, however, even when the developing sleeve 41 goes away from the center, the degree of decrease of the electric field is small, and as the result, the width of the development nip is large.

Accordingly, in the inter-polar development, the deviation width of toner is increased, the increasing inclination of the toner adhered amount from the central portion to the edge portion becomes more slow, and becomes hardly conspicuous as the density change of the developed image. This is confirmed by experiments. The results are shown below.

EXAMPLE 3

The present invention will be explained about the third example.

Development is carried out under the following developing conditions and image formation is carried out. The image forming apparatus shown in FIG. 1 is used for the image formation, and the developing apparatus shown in FIGS. 2 and 3 is used for development. The following conditions are set, the development method is respectively set to the inter-polar development and top-polar development, development is carried out by the above-described operations, and images are compared and evaluated.

Incidentally, as the image forming apparatus according to the present example, Konica KL-2010 color printer (made by Konica (Co.)) modified machine, shown in FIG. 1, is used, the outer diameter of the developing sleeve 41 is ϕ18 mm, and the outer diameter of the photoreceptor 1 is ϕ100 mm.

Setting conditions of the development processing are as follows.

The closest proximity distance d between the photoreceptor 1 and the developing sleeve 41=0.55 [mm];

Charging potential $V_H$: −750 [V];

DC voltage $V_{DC}$ applied on the developing sleeve 41: −600 [V];

Latent image potential VL on the photoreceptor 1 $V_L$: −50 [V],

AC voltage $V_{AC}$p-p applied on the developing sleeve 41: 2.5 [kV];

Yellow latent image PWM: 50%, magenta latent image PWM: 100% superimposition.

Evaluation of the color shift at the edge portion is shown in Table 3.

TABLE 3

| No. | | Developing method | Duty (%) $T_2/(T_1 + T_2)$ | B/P ratio $T_p/(T_p + T_B)$ | Secondary deviation width δ (mm) | Color shift of edge portion |
|---|---|---|---|---|---|---|
| 1 | Asymmetric wave pattern<br>Blank pulse<br>Developing sleeve: normal rotation | Inter-polar | 60 | 0.5 | 2.5 | B |
| 2 | Asymmetric wave pattern<br>Blank pulse<br>Developing sleeve: normal rotation | Top-polar | 60 | 0.5 | 2 | C |
| 3 | Asymmetric wave pattern | Inter-polar | 60 | 5 | A | |
| | Blank pulse<br>Developing sleeve: reverse rotation | Inter-polar | 60 | 0.5 | | |
| 4 | Asymmetric wave pattern<br>Blank pulse<br>Developing sleeve: reverse rotation | Top-polar | 60 | 0.5 | 3 | B |
| 5 | Symmetric wave pattern<br>Continuous wave<br>Developing sleeve: reverse rotation | Inter-polar | 50 | 1 | 5 | B |
| 6 | Symmetric wave pattern<br>Continuous wave<br>Developing sleeve: reverse rotation | Top-polar | 50 | 1 | 3 | C |

In each of No. 1–2 in Table 3, voltage with asymmetric blank pulse wave pattern (refer to FIG. 6) is applied on the developing sleeve 41. Further, in No. 1–2, the rotating direction of the developing sleeve 41 in the developing area is the same (normal rotation)as that of the photoreceptor 1 (refer to FIG. 11(*a*)). Further, development method of No. 1 is the inter-polar development, and development method of No. 2 is the top-polar development.

In No. 3–4, in the same manner as in No. 1–2, voltage with asymmetric blank pulse wave pattern is applied on the developing sleeve 41. However, in No. 3–4, the rotating direction of the developing sleeve 41 in the developing area is reverse (reverse rotation)to that of the photoreceptor 1. Further, development method of No. 3 is the inter-polar development, and development method of No. 4 is the top-polar development.

In each of No. 5–6, voltage with symmetric continuous wave pattern is applied on the developing sleeve 41. Further, in No. 5–6, the rotating direction of the developing sleeve 41 in the developing area is reverse (reverse rotation)to that of the photoreceptor 1. Further, development method of No. 5 is the inter-polar development, and development method of No. 6 is the top-polar development.

Duty in Table 3 expresses the shape of the waveform width by $T_2/(T_1+T_2)$ in % as shown in FIG. 6, and asymmetric wave pattern of No. 1–4 is $T_2/(T_1+T_2)=60$ (%), that is, $T_2>T_1$, and the symmetric continuous wave pattern of No. 5–6 is 50 (%), that is $T_1=T_2$.

The B/P ratio in Table 3 is expressed by $T_P/(T_P+T_B)$ as shown in the blank pulse in FIG. 7, and the asymmetric wave pattern of No. 1–4 is $T_P/(T_P+T_B)=0.5$, that is $T_P=T_B$. In the symmetric continuous wave pattern of No. 5–6, $T_B=0$, and B/P ratio is 1.

The secondary deviation width δ in Table 3 means the length of the secondary color change portion in which the secondary color of magenta toner Mt shown in FIG. 9 is little.

The color shift of the edge portion in Table 3 is a shift of color by a change of toner adhered amount generated at a boundary portion (edge portion)at which yellow toner Yt and magenta toner Mt are superimposed on each other as shown in FIG. 12.

As shown in Table 3, the development method, duty and B/P ratio are set and development processing is carried out, and the color shift of the formed color images are evaluated.

In the developing apparatus provided with the developing sleeve 41 which is reversely rotated, as shown in No. 3–6, the secondary deviation width δ appears with 3–5 mm width on the leading edge portion of the image, and appears wider than in the developing apparatus No. 1–2 provided with normally rotating developing sleeve 41. In this secondary deviation width δ, the wider it is, the more gentle is the secondary color change.

The color shift of the edge portion is judged by visual observation, and the image with no color shift is marked by A, the image with little color shift is marked by B, and the image with large color shift is marked by C.

In No. 3 developing apparatus of the present example in which developing bias voltage with the asymmetric blank pulse wave pattern, inter-polar development, and reversely rotated developing sleeve are adopted, there is no color shift at the edge portion, and an image with the fine hue can be obtained.

In another developing apparatus No. 1 with the inter-polar development arrangement, the color shift at the edge is more preferable as compared to No. 2 which has the top-polar development arrangement and the same other conditions, and in the same manner, No. 5 is more preferable as compared to No. 6.

When these experiment examples are integrated, in the No. 3 developing apparatus of the present invention having wider secondary deviation width δ and no color shift at the edge portion, an image with excellent hue can be obtained.

Incidentally, the developing apparatus in Examples 1–3 and the image forming apparatus provided with the developing apparatus are not limited to the above embodiments, but are applicable for a color image forming apparatus provided with a belt photoreceptor, a color image forming apparatus having a transparent photoreceptor, a tandem type color image forming apparatus, or the like. Further, developer used for the developing apparatus of the image forming apparatus of the present invention is not limited to two-component developer, but also applicable for one-component developer.

In the developing apparatus and the image forming apparatus in Examples 1–3, the absorption and white loss can be prevented from being generated, and sufficient density is obtained, excellent developer property and developing stability are obtained, and an image with high quality can be obtained.

Further, according to Example 3, when a portion on the developing carrier which is in closest proximity to the image carrier, is set between different magnetic poles of a plurality of magnetic poles, the secondary color change in the latent image potential gap can be made hardly conspicuous, and sufficient reflection density can be obtained, thereby, an image with excellent hue can be obtained.

What is claimed is:

1. An image forming apparatus, comprising:

charging means, arranged around an image carrier, for charging a surface of said image carrier;

exposure means, arranged around said image carrier, for exposing said surface of said image carrier, charged by said charging means, and for forming an electrostatic latent image on said surface of said image carrier;

developing means, having a developer carrier and arranged around said image carrier, for carrying developer with which said electrostatic latent image is developed so as to obtain a developed image, said developing means includes a bias voltage application means for applying a developing bias voltage, AC and DC voltages are superimposed between said developer carrier and said image carrier; and transfer means, arranged around said image carrier, for transferring said developed image onto a transfer material;

wherein said AC voltage is applied intermittently, and a waveform in one cycle (T1+T2) of each pulse during a term, in which AC voltage is applied, does not have a center of symmetry; and wherein an absolute value of a difference between a peak value of said AC voltage on a development driving side in which toner is moved from a developing sleeve onto a photoreceptor and a value of said DC voltage is larger than an absolute value of a difference between a peak value of said AC voltage on a returning side in which toner is moved from the photoreceptor to the developing sleeve and the value of said DC voltage.

2. The image forming apparatus of claim 1, wherein said developing means is arranged so as to have a space between said developer on said developer carrier and said image carrier, and an intermediate portion of adjacent magnetic poles (N,S) provided in said developer carrier is arranged facing said image carrier at a position where said developer carrier is closest to said image carrier.

3. The image forming apparatus of claim 2, wherein said developing means has a plurality of developing devices, each of which has color toner different from other color toners of other ones of said plurality of developing devices, and said plurality of developing devices are arranged around said image carrier adjacent each other.

4. The image forming apparatus of claim 1, wherein said developing means has a plurality of developing devices, each of which has color toner different from other color toners of other ones of said plurality of developing devices, and said plurality of developing devices are arranged around said image carrier adjacent each other.

5. The image forming apparatus of claim 4, wherein said transfer means transfers a superimposed color image formed by said plurality of developing devices to said transfer material at once so that a color image is formed on said transfer material.

6. The image forming apparatus of claim 1, wherein said apparatus satisfies:

$$(Vs/Vp)>2$$

wherein Vs is a peripheral speed of said developer carrier and Vp is a peripheral speed of said image carrier.

7. The image forming apparatus of claim 1, wherein the value of said DC voltage is an effective value of said AC voltage in one cycle.

8. The image forming apparatus of claim 1, wherein an integral value of said AC voltage in one cycle, which is higher than said DC voltage in one cycle, is equal to an integral value of said AC voltage in one cycle, which is lower than said DC voltage in one cycle.

9. An image forming apparatus, comprising;

charging means, arranged around an image carrier, for charging a surface of said image carrier;

exposure means, arranged around said image carrier, for exposing said surface of said image carrier, charged by said charging means, and for forming an electrostatic latent image on said surface of said image carrier;

developing means, having a developer carrier and arranged around said image carrier, for carrying developer with which said electrostatic latent image is developed so as to obtain a developed image, said developing means includes a bias voltage application means for applying a developing bias voltage, AC and DC voltages are superimposed between said developer carrier and said image carrier; and transfer means, arranged around said image carrier, for transferring said developed image onto a transfer material;

wherein said AC voltage is applied intermittently, and a waveform in one cycle (T1+T2) of each pulse during a term, in which AC voltage is applied, does not have a center of symmetry; and wherein said bias voltage application means applies said AC voltage and DC voltage so as to satisfy:

$$0.5<(T2/(T1+T2))<0.9$$

wherein T1 is the time to apply one side voltage of said AC voltage in relation to said DC voltage in one cycle where said developer is attracted from said developer carrier to said image carrier;

T2 is the time to apply one side voltage of said AC voltage in relation to said DC voltage in one cycle where said developer is attracted from said image carrier to said developer carrier; and T1+T2 is equal to the time of one cycle of said AC voltage.

10. An image forming apparatus, comprising:

charging means, arranged around an image carrier, for charging a surface of said image carrier;

exposure means, arranged around said image carrier, for exposing said surface of said image carrier, charged by said charging means, and for forming an electrostatic latent image on said surface of said image carrier;

developing means, having a developer carrier and arranged around said image carrier, for carrying developer with which said electrostatic latent image is developed so as to obtain a developed image; and transfer means, arranged around said image carrier, for transferring said developed image onto a transfer material;

wherein said developing means includes a bias voltage application means for applying a developing bias voltage, and AC and DC voltages are superimposed between said developer carrier and said image carrier;

wherein said AC voltage is intermittently applied;

wherein a waveform in one cycle (T1+T2) of each pulse during a'term that AC voltage is applied does not have a center of symmetry;

wherein said bias voltage application means applies said AC voltage so as to satisfy:

$$0.1<(T_p/(T_p+T_b))<0.9$$

wherein $T_p$ is the time to apply said AC voltage and $T_b$ is the time to suspend applying said AC voltage.

11. An image forming apparatus, comprising:

charging means, arranged around an image carrier, for charging a surface of said image carrier;

exposure means, arranged around said image carrier, for exposing said surface of said image carrier, charged by said charging means, and for forming an electrostatic latent image on said surface of said image carrier;

developing means, having a developer carrier and arranged around said image carrier, for carrying developer with which said electrostatic latent image is developed so as to obtain a developed image; and transfer means, arranged around said image carrier, for transferring said developed image onto a transfer material;

wherein said developing means includes a bias voltage application means for applying a developing bias voltage, and AC and DC voltages are superimposed between said developer carrier and said image carrier;

wherein said AC voltage is intermittently applied;

wherein a waveform in one cycle (T1+T2) of each pulse during a term that AC voltage is applied does not have a center of symmetry, and satisfying:

$$(-4\ \mathrm{Emax}+11.3+0.4(f-4))<(T_p/(T_p+T_b))<(-4\ \mathrm{Emax}+18.9+0.4(f-4))$$

$$\mathrm{Emax}+(\tfrac{1}{2}\ V_{AC}+|V_{DC}|-|V_L|)/d$$

wherein Emax is the maximum electric field wherein said developer is attracted from said developer carrier to said image carrier, $V_{AC}$ is an effective peak-to-peak value of said AC voltage applied by said bias voltage application means, $V_{DC}$ is a value of said DC voltage applied by said bias voltage application means, $V_L$ is the minimum electric potential of said electrostatic latent image formed on said image carrier, d is the minimum distance between said developer carrier and said image carrier, $T_p$ is the time to apply said AC voltage, $T_b$ is the time to suspend applying said AC voltage, and f is a frequency of said AC voltage applied by said bias voltage application means during said time $T_p$.

* * * * *